US010981078B2

(12) United States Patent
Li

(10) Patent No.: US 10,981,078 B2
(45) Date of Patent: Apr. 20, 2021

(54) METHODS FOR A STAGE PERFORMANCE

(71) Applicant: Hongzhi Li, Cuddebackville, NY (US)

(72) Inventor: Hongzhi Li, Cuddebackville, NY (US)

( * ) Notice: Subject to any disclaimer, the term of this patent is extended or adjusted under 35 U.S.C. 154(b) by 0 days.

(21) Appl. No.: 16/203,740

(22) Filed: Nov. 29, 2018

(65) Prior Publication Data

US 2019/0192990 A1 Jun. 27, 2019

Related U.S. Application Data

(60) Provisional application No. 62/593,453, filed on Dec. 1, 2017.

(51) Int. Cl.

| | |
|---|---|
| ***A63J 5/02*** | (2006.01) |
| ***A63J 1/02*** | (2006.01) |
| *G06T 15/00* | (2011.01) |

(52) U.S. Cl.
CPC *A63J 5/021* (2013.01); *A63J 1/02* (2013.01)

(58) Field of Classification Search
CPC ..... G06T 15/00; G06T 15/70; G06T 15/15; G06T 2207/10016; G06T 2207/30196; A63J 1/00; A63J 5/00; A63J 5/02; A63J 5/021
USPC ..... 345/435, 473; 472/57, 75
See application file for complete search history.

(56) References Cited

U.S. PATENT DOCUMENTS

| | | | | |
|---|---|---|---|---|
| 5,790,124 | A * | 8/1998 | Fischer | G06T 15/10 345/473 |
| 5,964,064 | A | 10/1999 | Goddard | |
| 6,130,677 | A * | 10/2000 | Kunz | G06F 3/011 345/630 |
| 6,253,494 | B1 | 7/2001 | Shaffron | |
| 9,468,860 | B2 | 10/2016 | Li | |
| 2011/0285854 | A1* | 11/2011 | LaDuke | G01S 11/00 348/169 |

* cited by examiner

*Primary Examiner* — Kien T Nguyen
(74) *Attorney, Agent, or Firm* — Todd L. Sladek

(57) ABSTRACT

Disclosed are methods that create the perception for an audience that an actor is being transported from one location to another during a stage performance. Also disclosed are methods for entrance onto/exit from a stage platform by an actor, or entrance onto/exit from a stage backdrop by a precision image that represents an actor. The disclosed methods involve interaction of an actor with an object/prop or image of an object/prop, and/or involve interaction of an image of an actor with an object/prop or image of an object/prop during a stage performance.

12 Claims, 23 Drawing Sheets

METHODS FOR A STAGE PERFORMANCE

CROSS-REFERENCE TO RELATED APPLICATION

This application claims priority to U.S. Provisional Patent Application Ser. No. 62/593,453, filed Dec. 1, 2017.

BACKGROUND

In a stage performance, actors perform for an audience. The actors generally enact certain situations, called scenes, on a stage platform. Positioned behind the stage platform, and visible to an audience, there may be a stage backdrop. In some instances, digital projection may be used to display various images on the stage backdrop. The images may enhance the various scenes that are performed by the actors. Digital projection may allow the images to be changed during a stage performance, and/or may allow the images to move or be animated on the stage backdrop during the stage performance. The result is generally an enhanced experience for an audience viewing the stage performance.

BRIEF DESCRIPTION OF THE DRAWINGS

In the accompanying drawings, which are incorporated in and constitute a part of the specification, embodiments of methods for a stage performance are illustrated. It will be appreciated that the embodiments illustrated in the drawings are shown for the purpose of illustration and not for limitation. It will be appreciated that changes, modifications and deviations from the embodiments illustrated in the drawings may be made without departing from the spirit and scope of the invention, as disclosed below.

In FIG. 2A, an actor is standing on a stage platform. To the actor's right, on the stage platform, is a prop that represents a water well. In the interior of the water well prop, there may be an opening in the stage platform (not shown), large enough for an actor to enter. In one example, the opening in the stage platform is created by opening of a trap door existing in the stage platform. Also shown in FIG. 2A is a stage backdrop, on which is displayed a mountain horizon and the sun in the sky.

FIG. 2B shows that the actor has moved to her right and has leapt into the interior of the water well prop. To an audience positioned in front of the stage platform, the appearance is of the actor jumping into the water well.

FIG. 2C shows the actor located in the interior of the water well. The actor may still be positioned on the stage platform, hidden from the audience by the water well prop, as shown in the figure. The actor may have moved through a trap door opening in the stage platform and may be positioned on a platform beneath the main stage (e.g., substage). In this position, the actor is not visible to the audience and it appears to the audience that the actor has left the stage platform by jumping into the water well.

FIG. 2D represents a dark stage (e.g., a blackout or scene change). In practice, the whole theater may be dark (the lights may be dimmed or turned off) or the stage only may be dark (lights illuminating the stage may be dimmed or turned off). During the time the lights are dimmed/turned off, the stage platform is not visible to the audience. During this time, in one example, stage hands enter onto the stage platform and remove the water well prop. The actor, if still on the stage platform, may also exit the stage platform. If the actor has moved through the trap door opening in the stage platform, the trap door may be closed during the blackout. The dark stage generally obscures or prevents the audience from seeing events that occur on the stage during this time.

In FIG. 2E, the lights have been turned on and the stage is now visible to the audience. The water well prop on the stage platform is gone. There is an image of the water well now displayed on the stage backdrop. In this example, the image of the water well also shows an image of the actor who was previously on the stage platform, now inside the image of the water well (at this point in time, the image of the actor may or may not be visible to the audience). The appearance to the audience is that the well on the stage platform has been transported to the stage backdrop during the time the stage was dark.

FIG. 2F shows animation of the image on the stage backdrop such that the image of the actor emerges from the image of the water well and is standing near the water well. The audience perceives the actor as having leapt out of the water well onto the stage backdrop.

The entire sequence of events shown in FIGS. 2A-F are perceived by the audience as an actor on a stage platform, exiting the stage platform by jumping into a water well. The water well is then transported onto the stage backdrop (scene change), and the actor (image of the actor that was on the stage platform) emerges from the water well onto the stage backdrop. The actor may be said to have been transported from stage platform (actor) to stage backdrop (image of the actor) by a prop which, in this example, is a water well.

Figure 1:
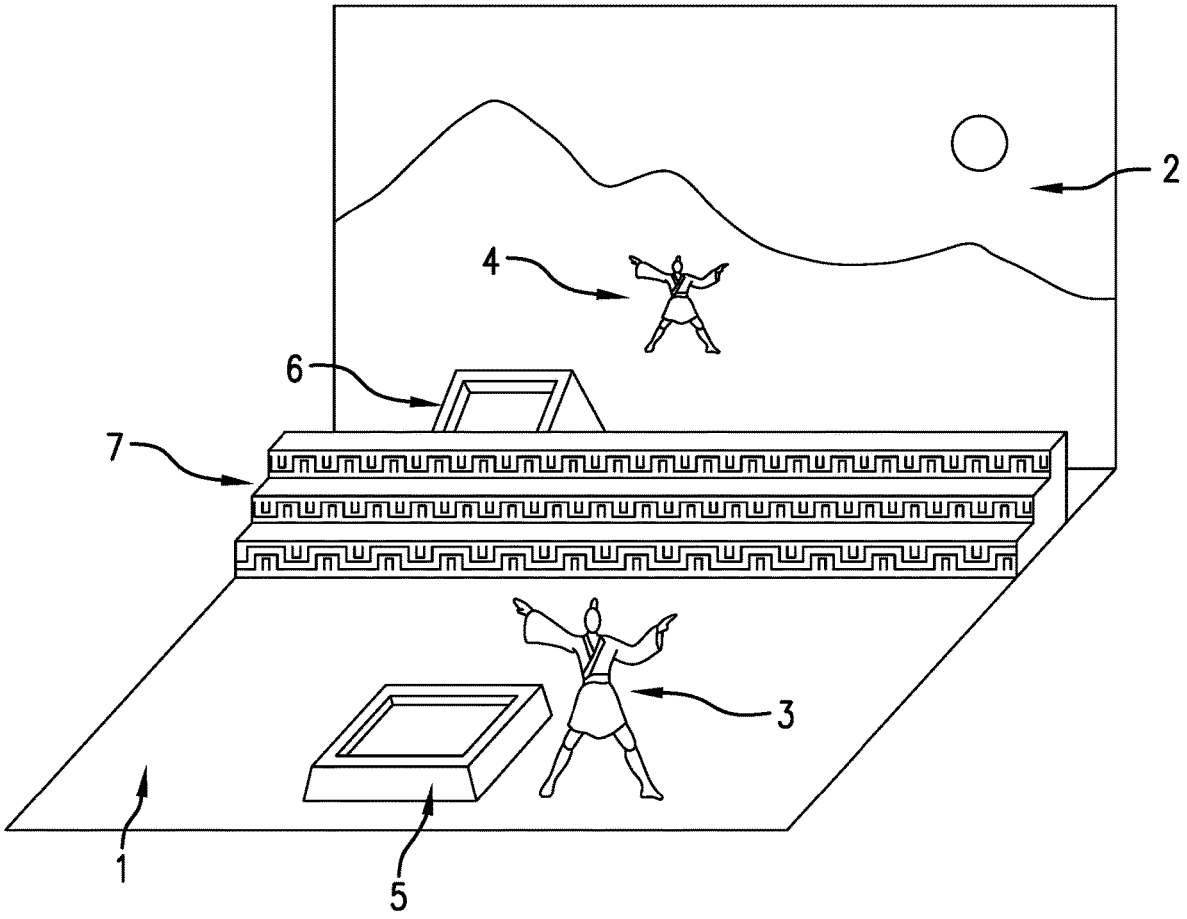
FIG. 1 illustrates various components related to a stage performance for describing embodiments of the methods disclosed herein. One (1) is an example stage platform. Two (2) is an example stage backdrop. In some examples, the stage platform and a stage backdrop may be referred to as a stage. Three (3) is an example actor, positioned on the stage platform. Four (4) is an image of an actor, displayed on the stage backdrop. Five (5) is a prop of a water well, positioned on the stage platform. Six (6) is an image of a water well, displayed on the stage backdrop. Seven (7) are raised stairs, positioned on the stage platform. In some examples, the raised stairs may be considered a prop.
Figure 2A:
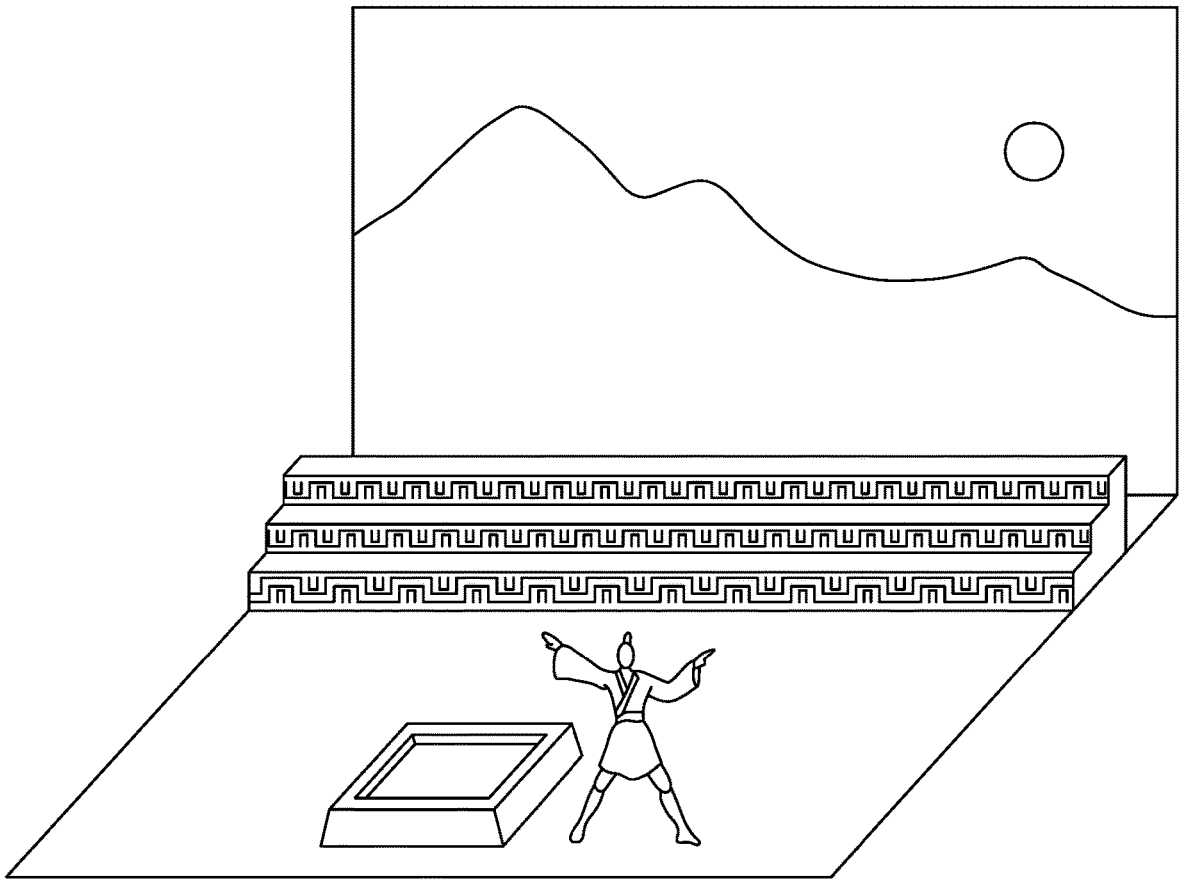
FIGS. 2A-F illustrate a chronological series of images from an example of exit of an actor from a stage platform (and transport to a stage backdrop), using an embodiment of the methods disclosed herein.
Figure 2B:
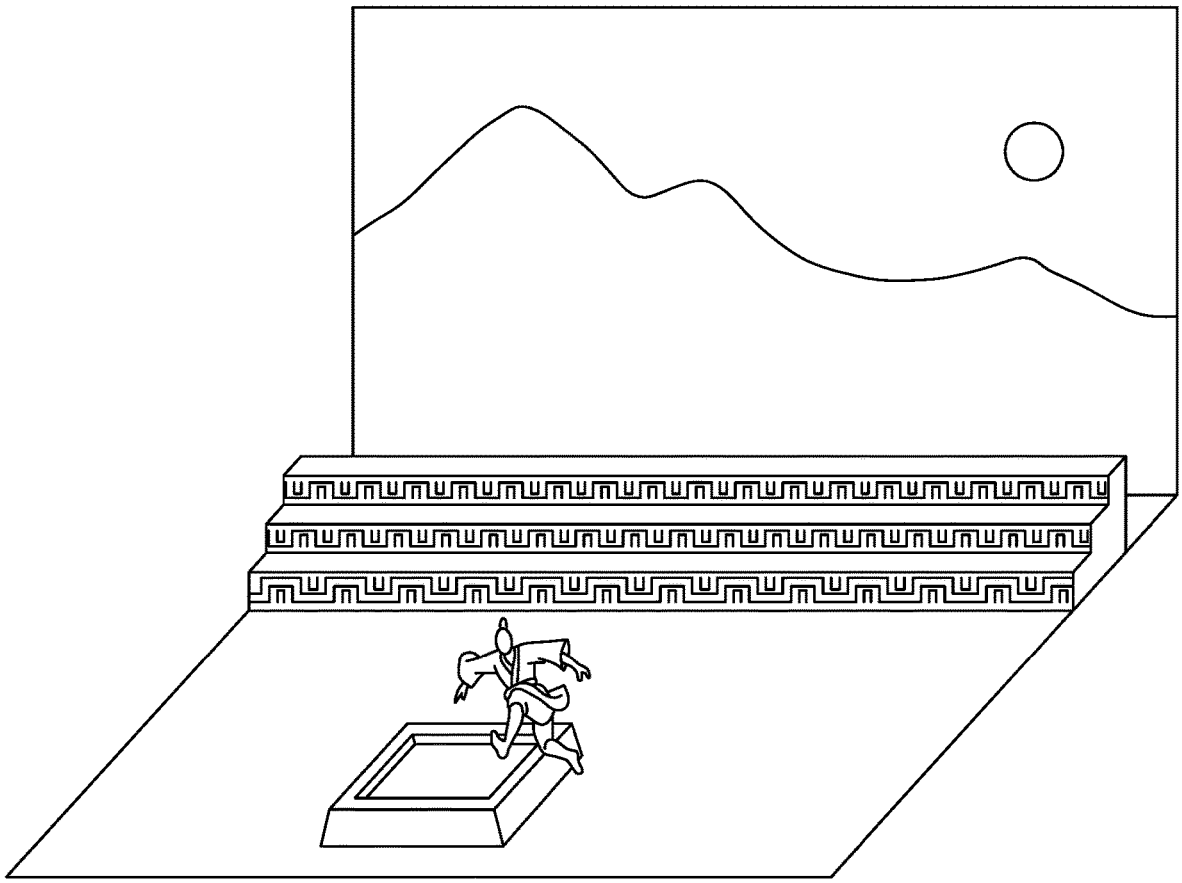
Figure 2C:
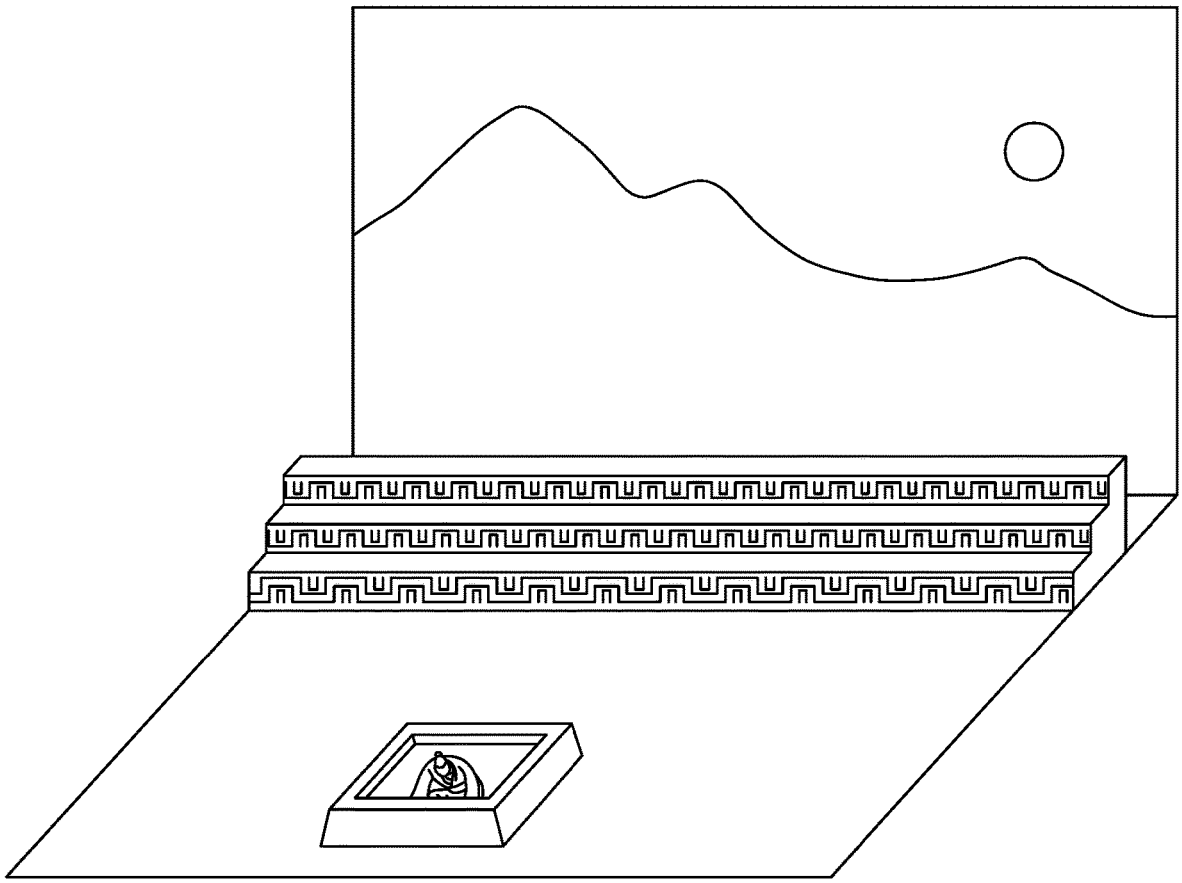

In various embodiments of the method, the events shown in FIGS. 2A-C or in FIGS. 2A-D may occur alone as a method of an actor exiting a stage platform. In various embodiments of the method, the events shown in FIGS. 2E-F or in FIGS. 2D-F may occur alone as a method of an image of an actor entering onto a stage backdrop. In some examples, the prop may not be of a water well. In some examples, the raised stairs may not be present.

Figure 3A:
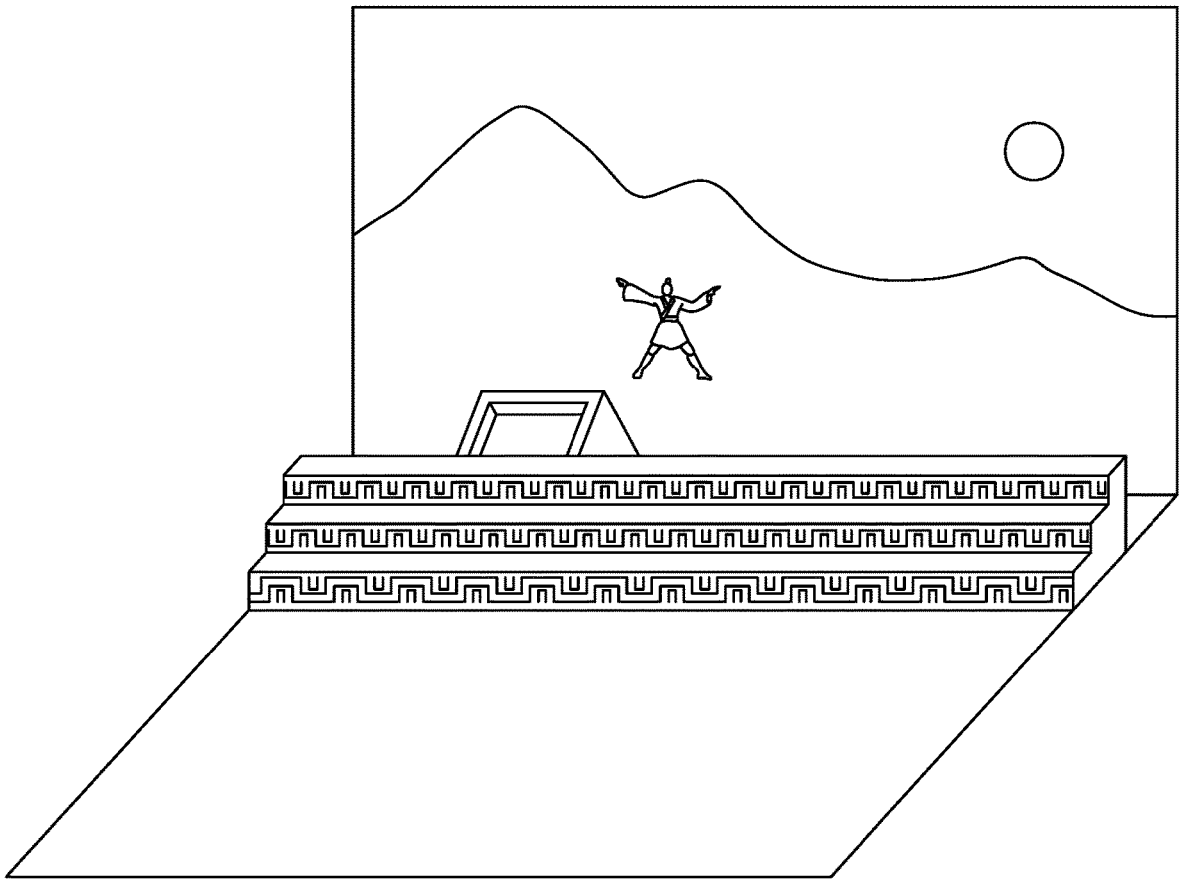

FIGS. 3A-E illustrate a chronological series of images from an example of entrance of an actor onto a stage platform (transported to the stage platform from the stage backdrop), using an embodiment of the methods disclosed herein. FIG. 3A shows an image of an actor displayed on a stage backdrop. To the left and beneath the image of the actor, as viewed by the audience, is an image of a water well prop, also displayed on the stage backdrop. In front of the stage backdrop is a stage platform.

Figure 3B:
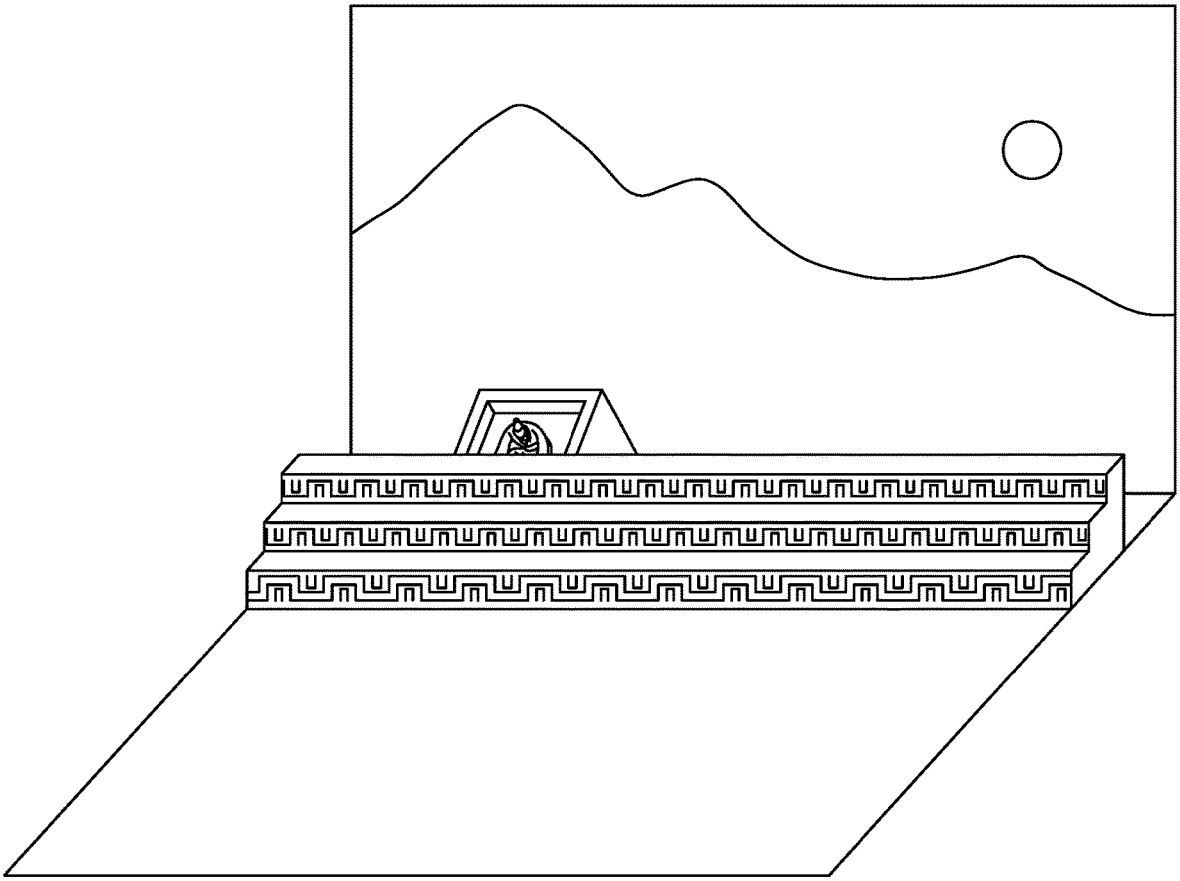

In FIG. 3B, the image of the actor is shown inside of the image of the water well prop. Chronologically, between FIG. 3A and FIG. 3B, the image of the actor was animated on the stage backdrop such that the actor was perceived by the audience to have leapt into the water well. The image of the actor may be visible inside of the image of the water well prop, or may not be visible, giving the impression to the audience that the actor has jumped into and disappeared inside the image of the water well prop.

Figure 3C:
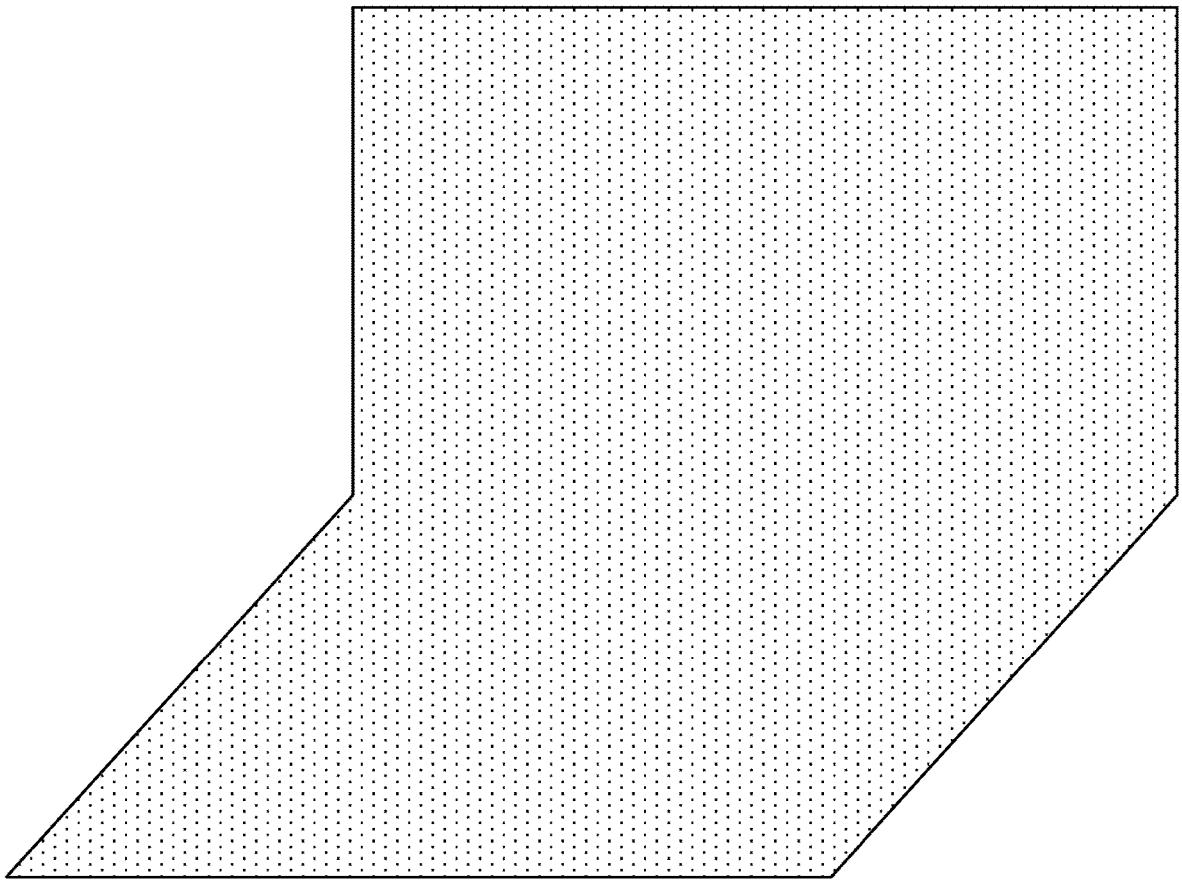

FIG. 3C represents a dark stage (e.g., a blackout). In practice, the whole theater may be dark (the lights may be dimmed or turned off) or the stage only may be dark (lights illuminating the stage may be dimmed or turned off). During the time the lights are dimmed/turned off, the stage platform is not visible to the audience. During this time, in one example, stage hands enter onto the stage platform and place a prop of a water well on the stage platform. In one example, the prop of the water well may be positioned over the top of an opening in the stage platform which may be created by opening a trap door in the stage platform. An actor may be located on a platform beneath the main stage platform. In another example, an actor may be concealed within the prop of the water well that is placed on the stage platform during the blackout. The dark stage generally obscures or prevents the audience from seeing events that occur on the stage during this time. The period during which the stage is dark facilitates a scene change during the stage performance.

Figure 3D:
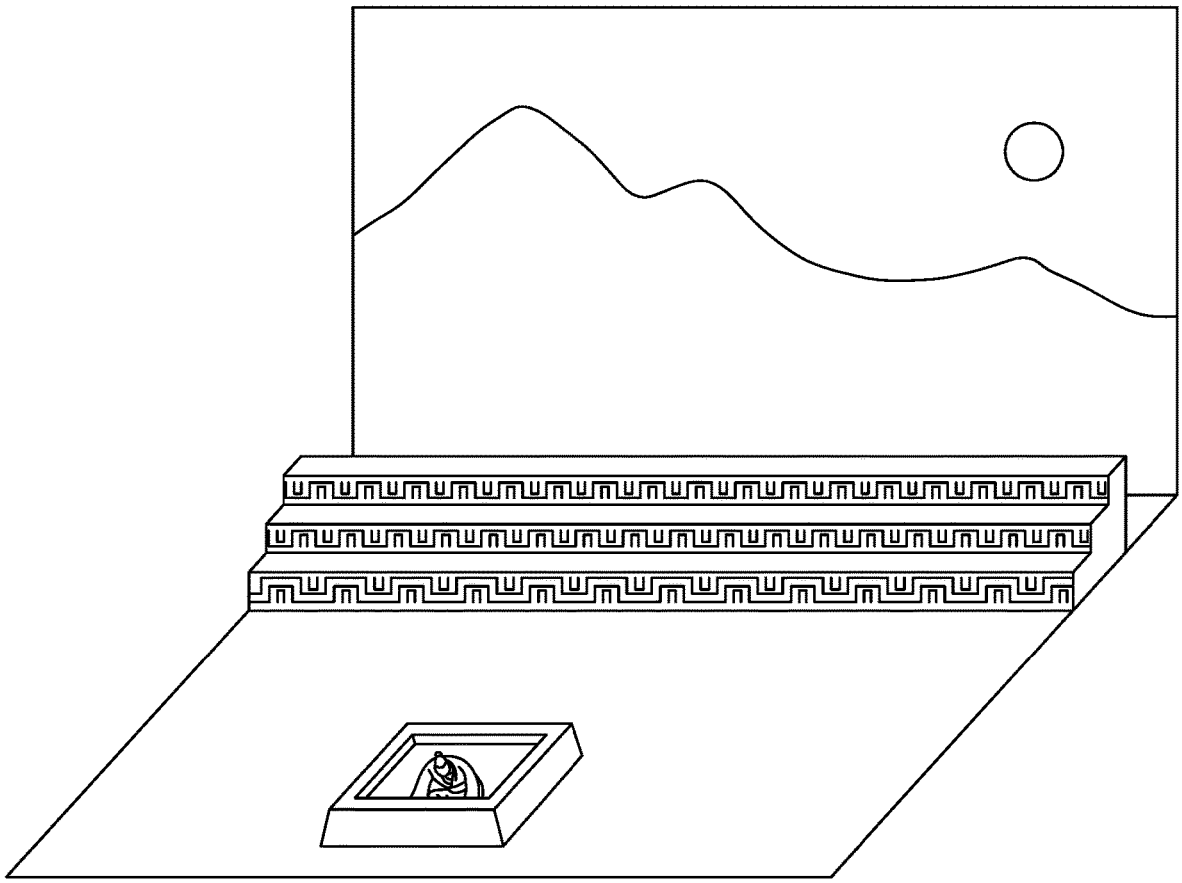

In FIG. 3D, the lights have been turned on and the stage is now visible to the audience. The image of the water well containing the image of the actor on the stage backdrop is gone. There is a prop of a water well now on the stage platform. An actor is shown inside the water well prop, in this example, and may be positioned inside the prop of the water well, or on a platform located beneath the main stage platform (e.g., substage). In this position, the actor is not visible to the audience. The appearance to the audience is that the water well on the stage backdrop (and the actor inside the water well) has been transported to the stage platform during the time the stage was dark.

Figure 3E:
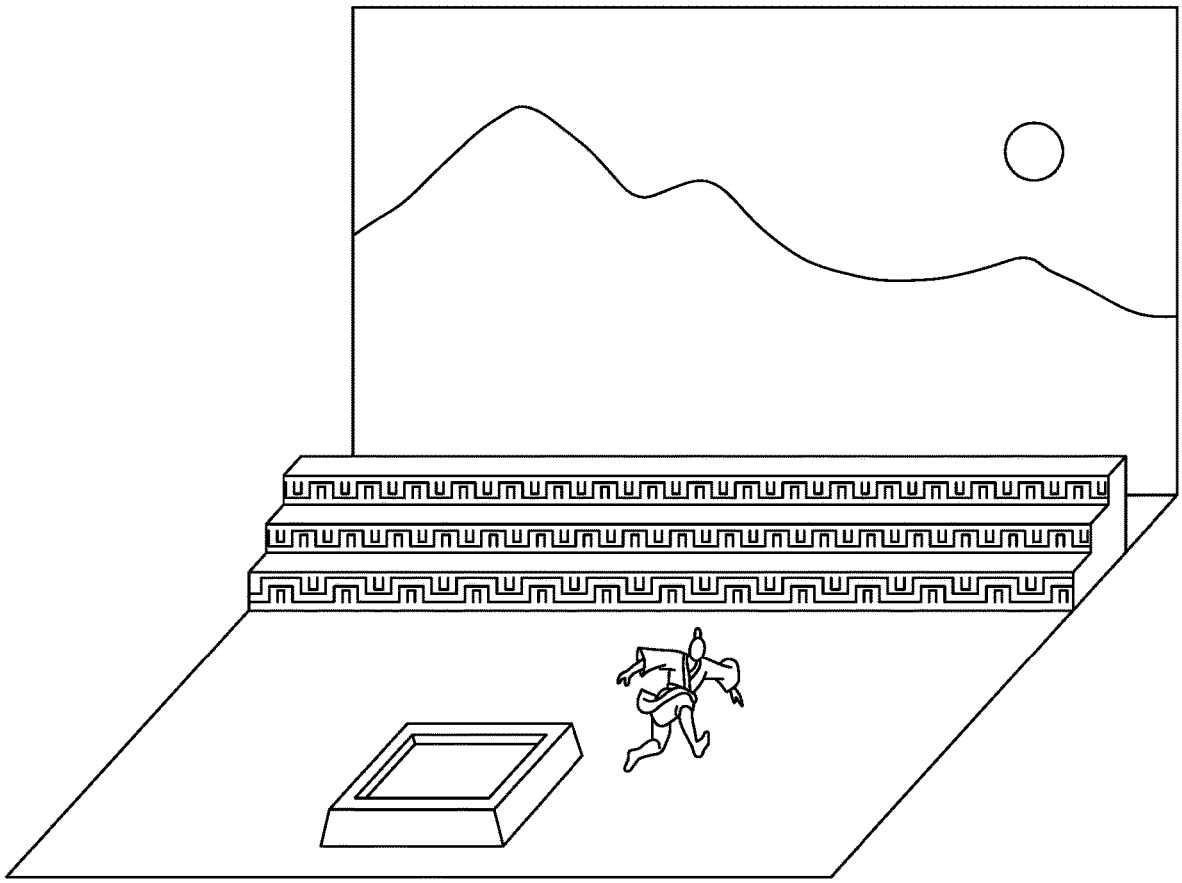

FIG. 3E, shows an actor that has emerged from the water well prop (the actor has come up from the sub-stage platform, through the water well prop, onto the main stage platform, or, perhaps, has emerged from the water well prop itself) and is running away from the water well prop.

The entire sequence of events shown in FIGS. 3A-E are perceived by the audience as an actor exiting the stage backdrop by jumping into a water well displayed on the stage backdrop. The water well is then transported onto the stage platform, and the actor emerges from the water well and enters onto the stage platform. The actor (image of the actor) may be said to have been transported from the stage backdrop onto the stage platform (actual, live actor) by the prop which, in this example, is a water well.

In various embodiments of the method, the events shown in FIGS. 3A-B or in FIGS. 3A-C may occur alone as a method of an image of an actor exiting a stage backdrop. In various embodiments of the method, the events shown in FIGS. 3D-E or in FIGS. 3C-E may occur alone as a method of an actor entering onto a stage platform. In some examples, the prop may not be of a water well. In some examples, the raised stairs may not be present.

Figure 4A:
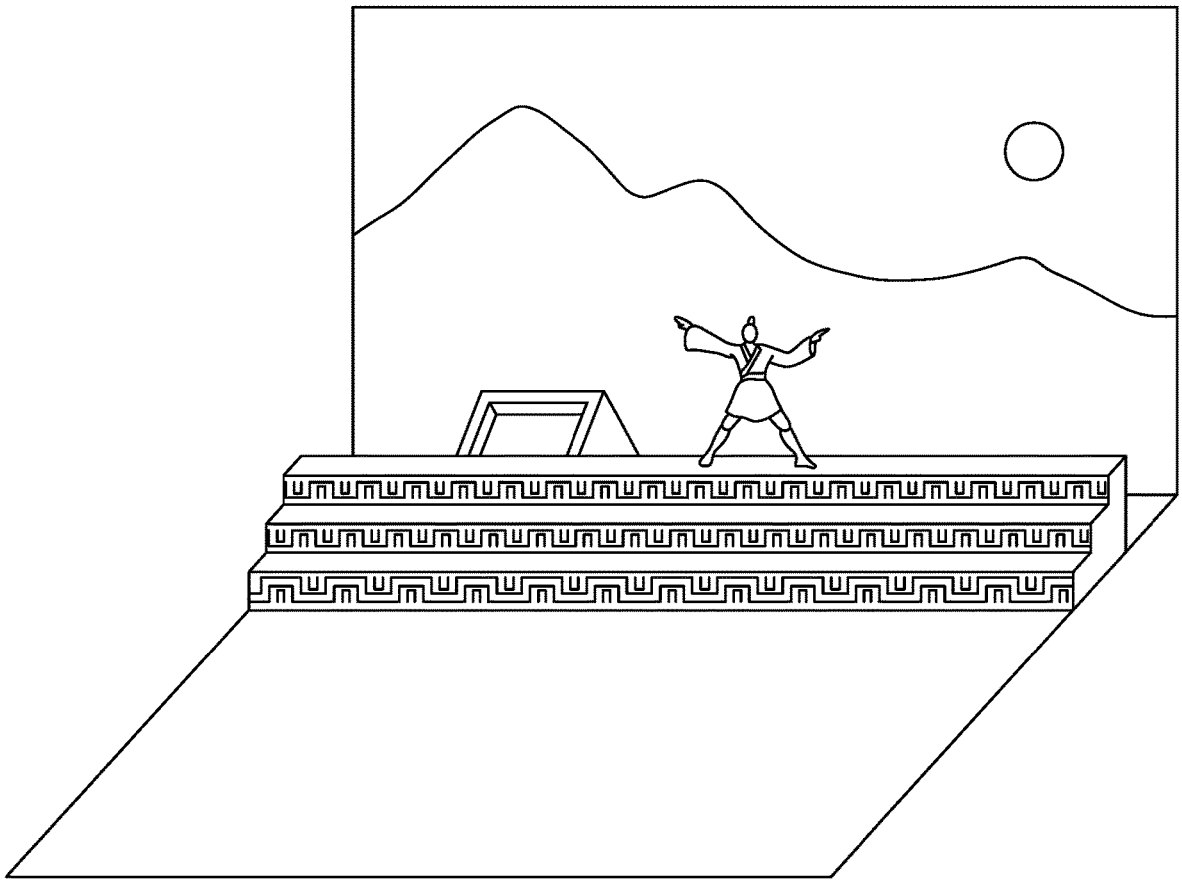

FIGS. 4A-F illustrate a chronological series of images from an example of exit of an actor from a stage platform using an embodiment of the methods disclosed herein. In FIG. 4A, an actor is standing on raised stairs that are positioned on a stage platform, and an image of a water well is displayed on a stage backdrop, to the actor's right. Also displayed on the stage backdrop is a mountain horizon and the sun in the sky.

Figure 4B:
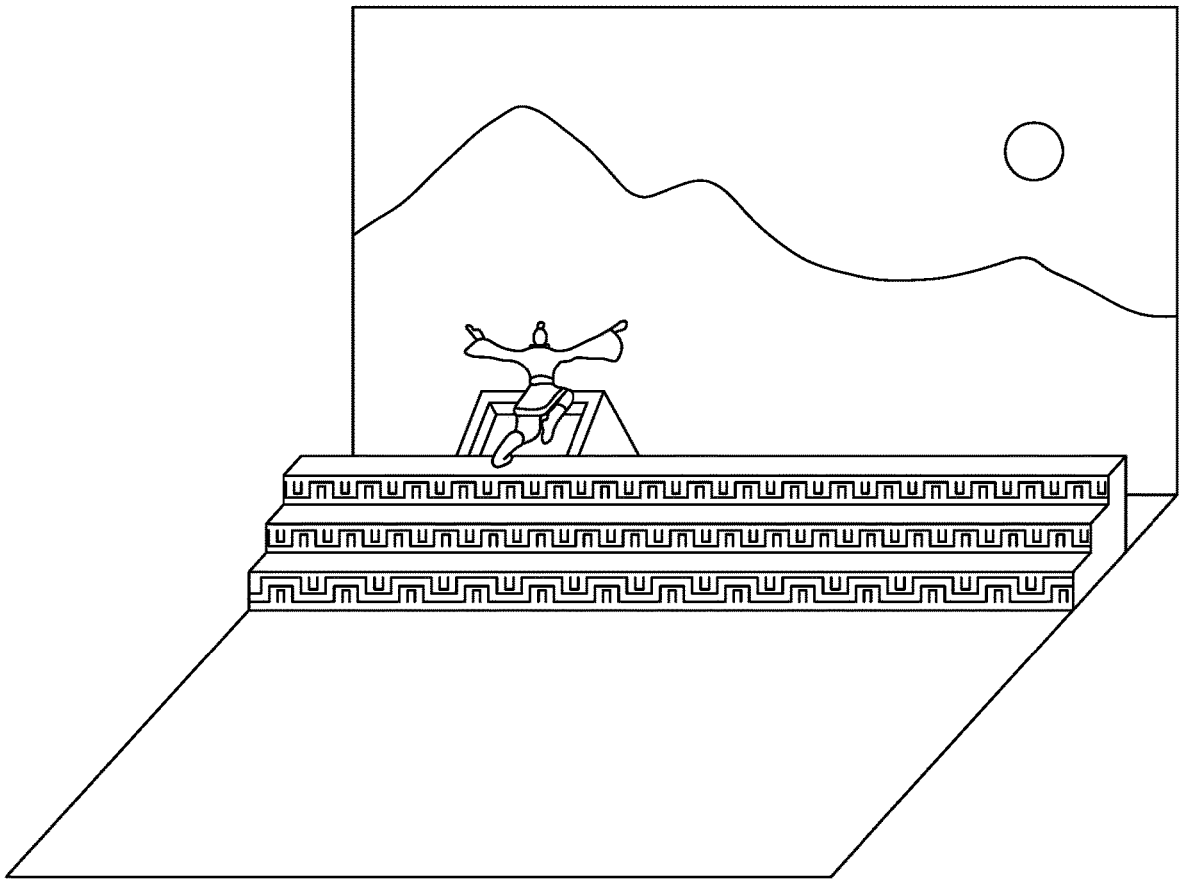

FIG. 4B shows that the actor has moved to her right on the raised stairs, positioned herself in front of the image of the water well, and has leapt from the raised stairs, seemingly into the water well.

Figure 4C:
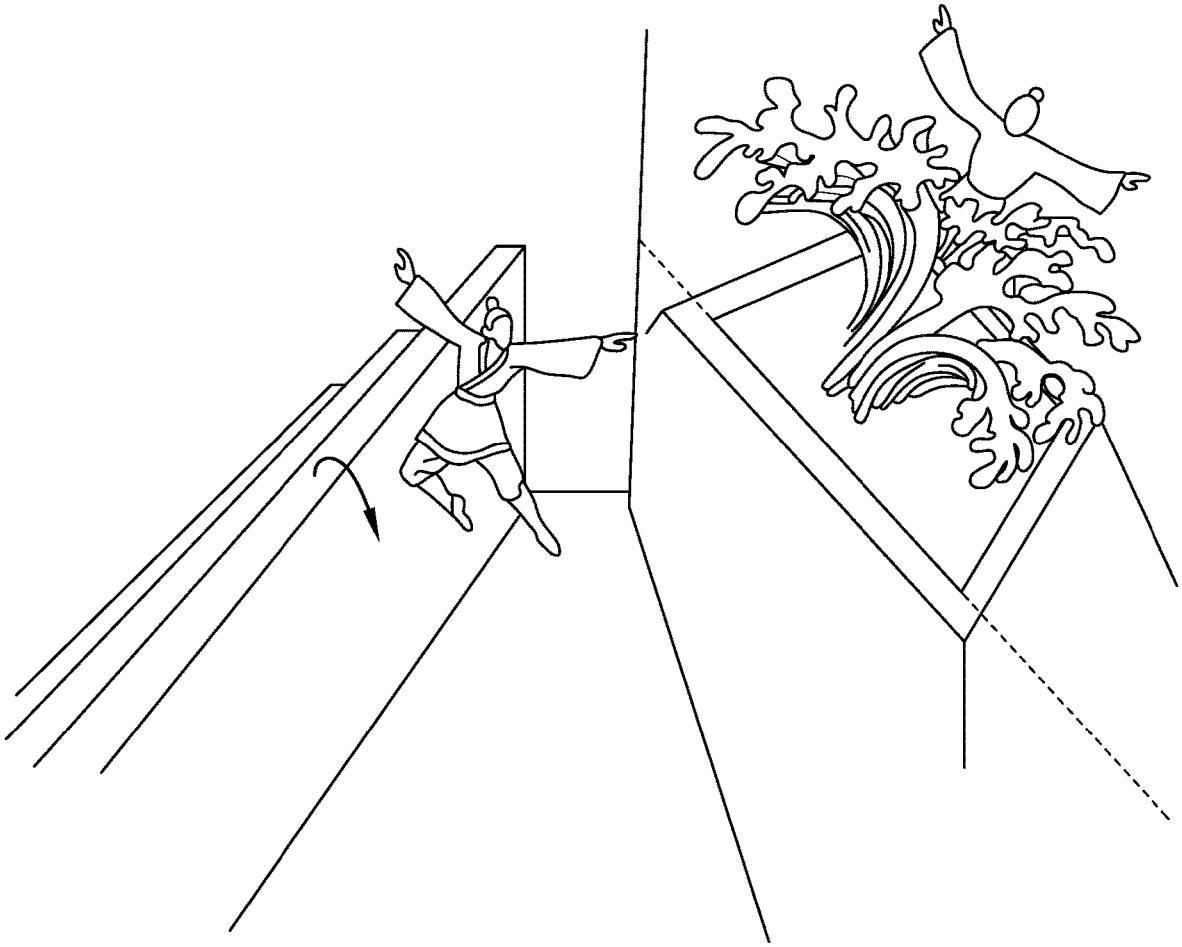

FIG. 4C shows the positioning of the raised stairs on the stage platform, with respect to the stage backdrop. The space between the raised stairs and the stage backdrop, created by the positioning, is shown. The actor is shown, after having leapt from the raised stairs, moving into the space between the raised stairs and the stage backdrop. The actor is only partially visible to the audience in the position shown. Also shown is animation of the image of the water well on the stage backdrop. The image depicts the actor partially entered into the water well with a resulting splash of water, as might occur if the actor had leapt into an actual water well.

Figure 4D:
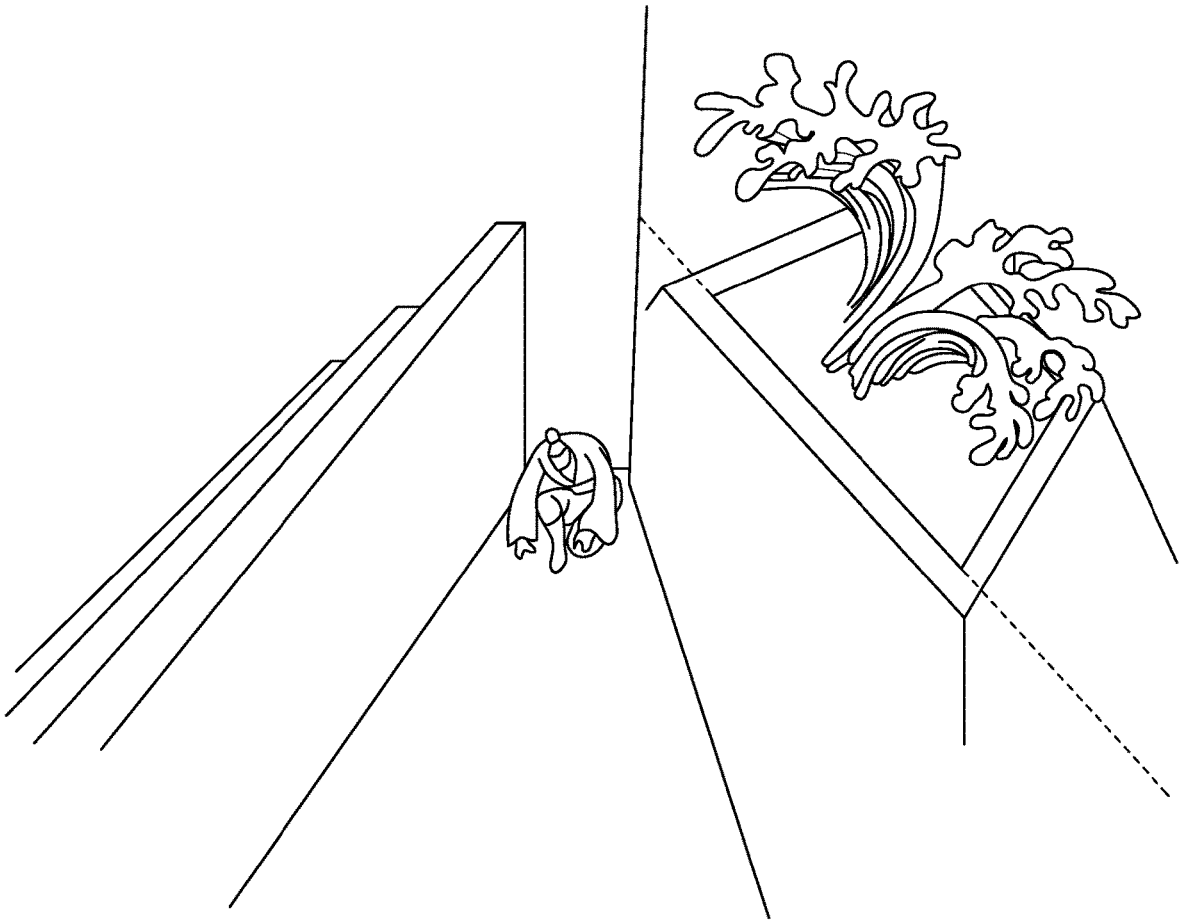
Figure 4E:
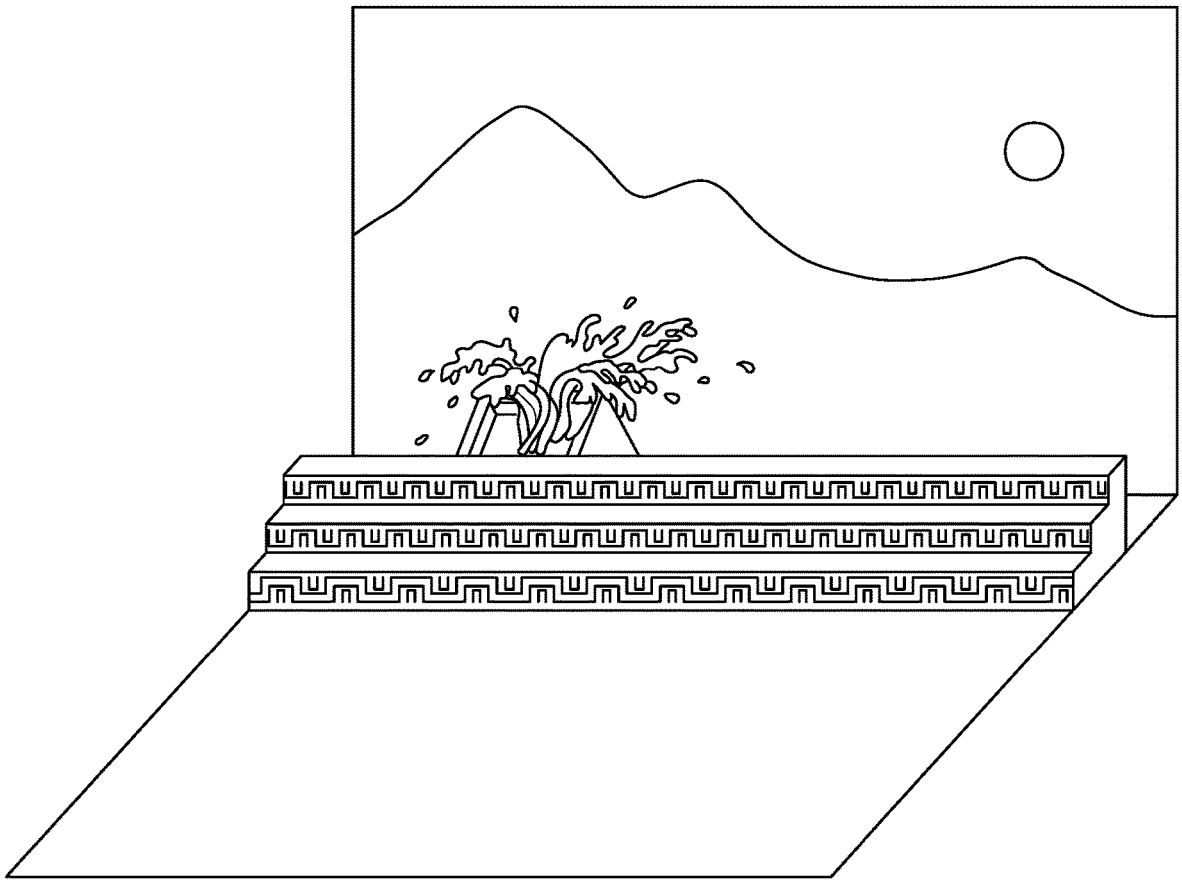

FIG. 4D shows the actor fully positioned in the space between the raised stairs and the stage backdrop. The actor is not visible to the audience in the position shown. Also shown on the stage backdrop is animation of the image of the water well that depicts the actor entirely entered into the water well (the actor is not visible in the image displayed on the stage backdrop), with the water splash. FIG. 4E shows the scene shown in FIG. 4D, except from the view of the audience, in front of the stage platform.

Figure 4F:
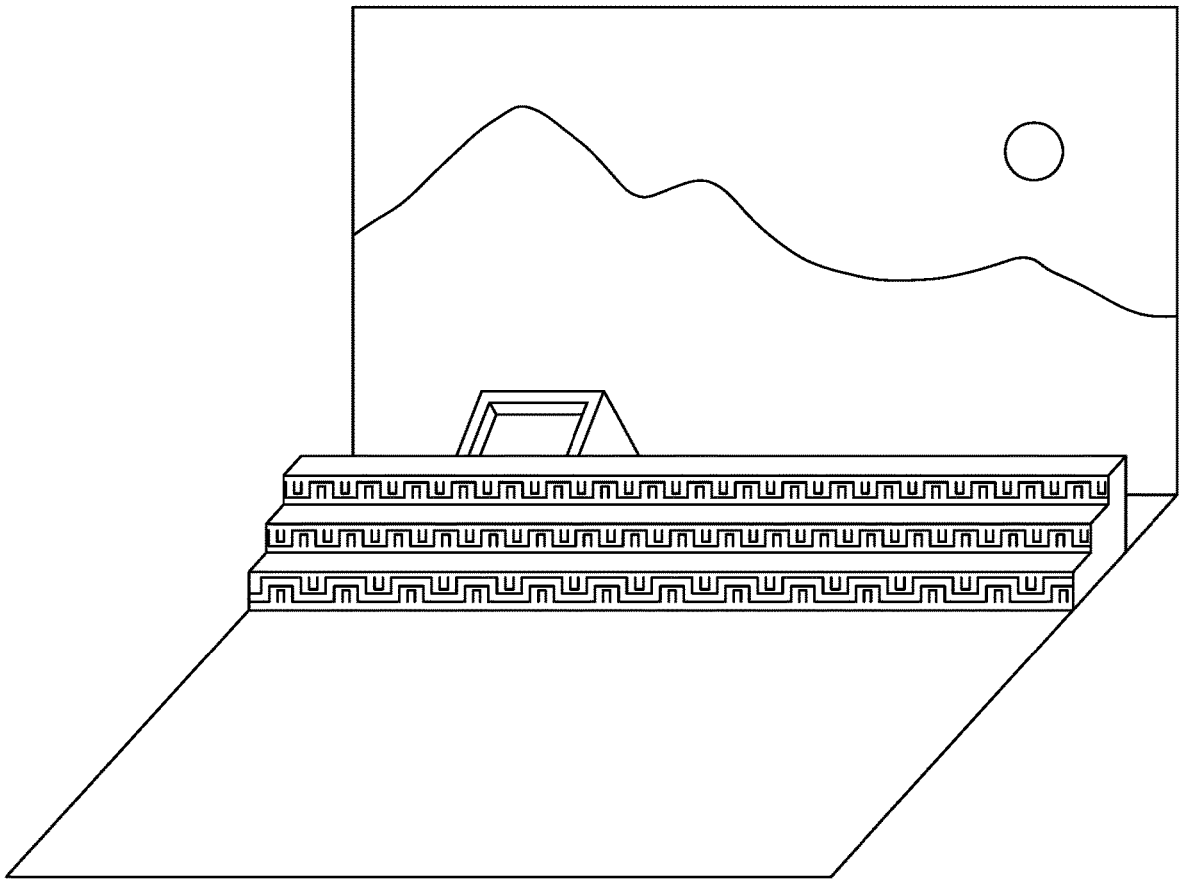

FIG. 4F is a similar view, at a chronological time slightly later than that shown in FIG. 4D, showing that the water splash has ended. The entire sequence of events shown in FIGS. 4A-F are perceived by the audience as an actor on raised stairs on a stage platform, exiting the stage platform by jumping into a water well.

Figure 2D:
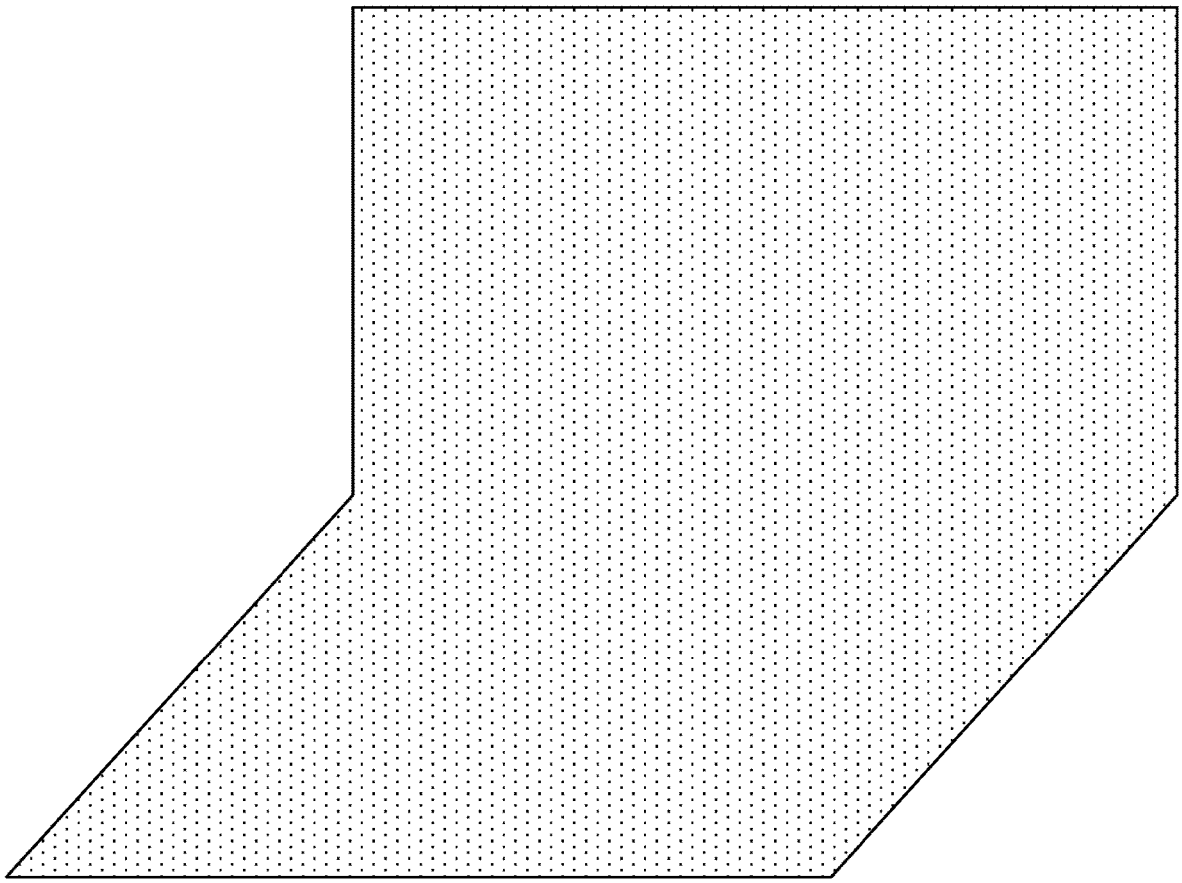
Figure 2E:
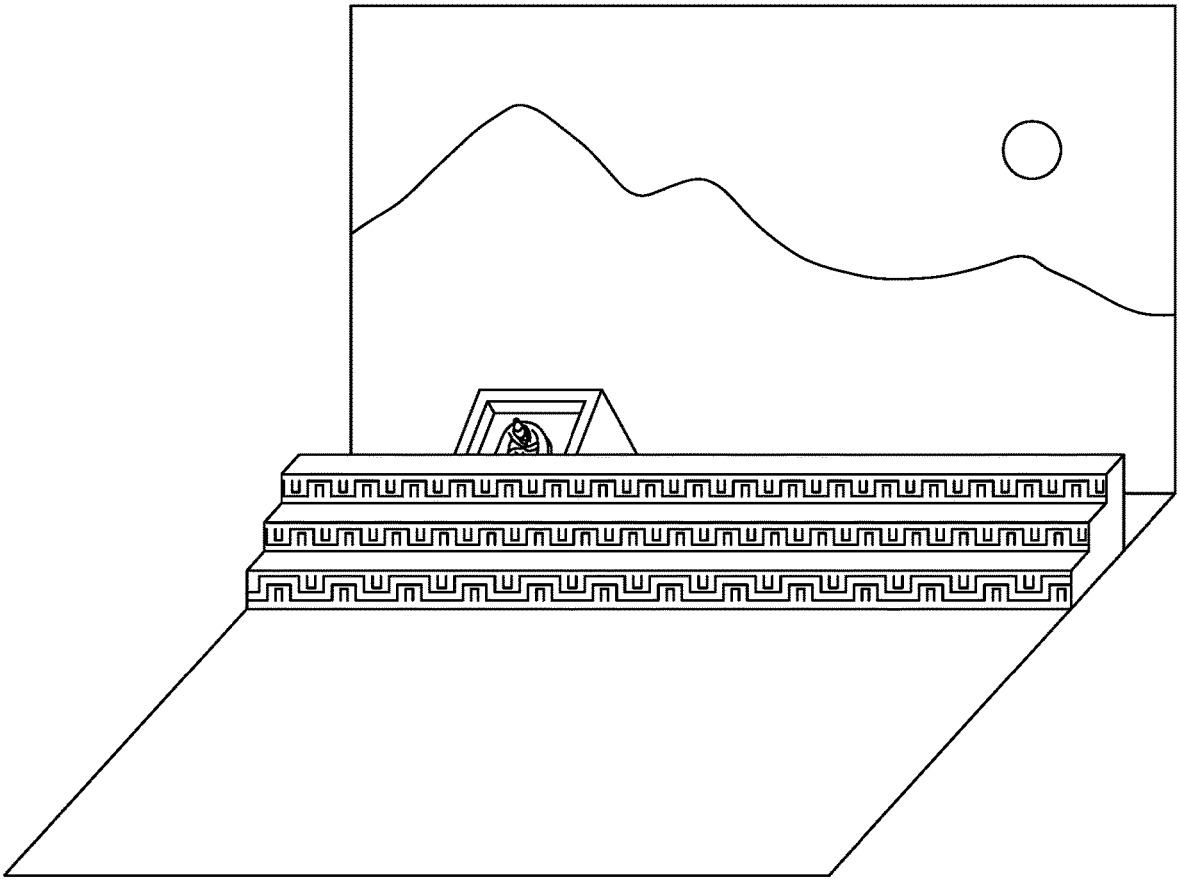
Figure 2F:
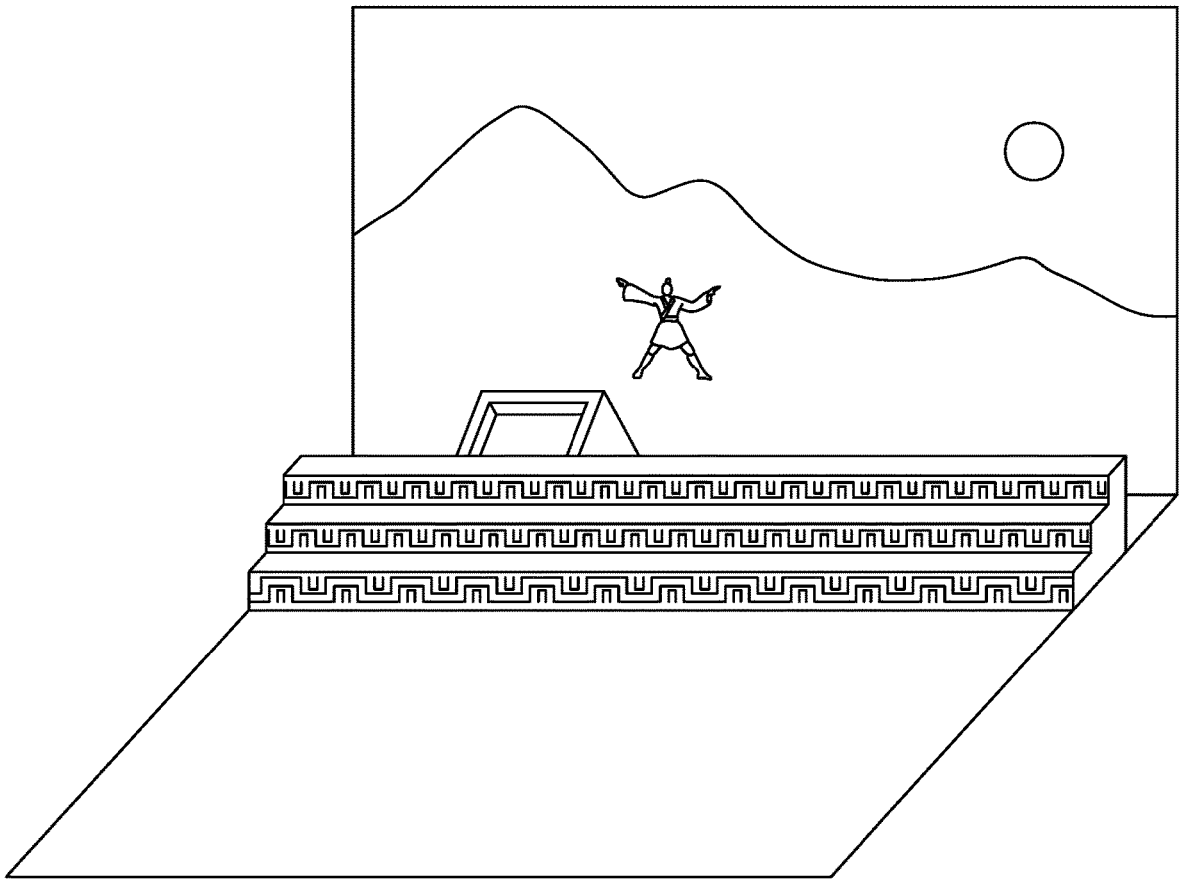

In various embodiments, the events shown in FIGS. 4A-F, that result in an actor exiting the stage, may be followed by events that result in entry of the actor back onto the stage platform (e.g., FIGS. 3C-E, FIGS. 5A-E) or entry of an image of the actor onto the stage backdrop (e.g., FIGS. 2D-F). In some examples, the prop may not be of a water well. In some examples, the raised stairs may not be present. In some examples, an object other than raised stairs may be used, for example, to obscure an actor from view of an audience.

Figure 5A:
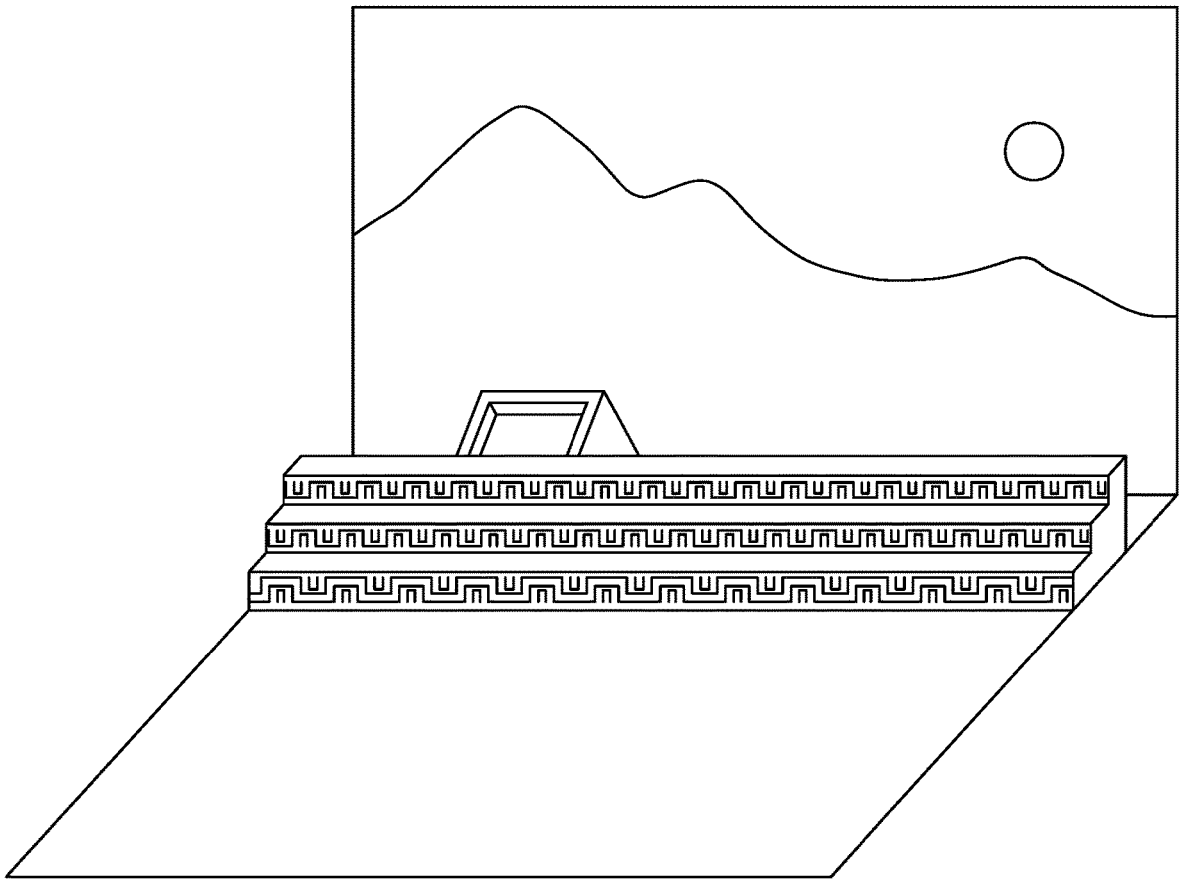

FIGS. 5A-E illustrate a chronological series of images from an example of entrance of an actor onto a stage platform, using an embodiment of the methods disclosed herein. FIG. 5A shows an audience's view of a stage platform, with raised stairs positioned near the back of the stage platform, and with a stage backdrop at the rear of the stage platform, onto which is displayed an image of a water well and a mountain horizon with the sun in the sky.

Figure 5B:
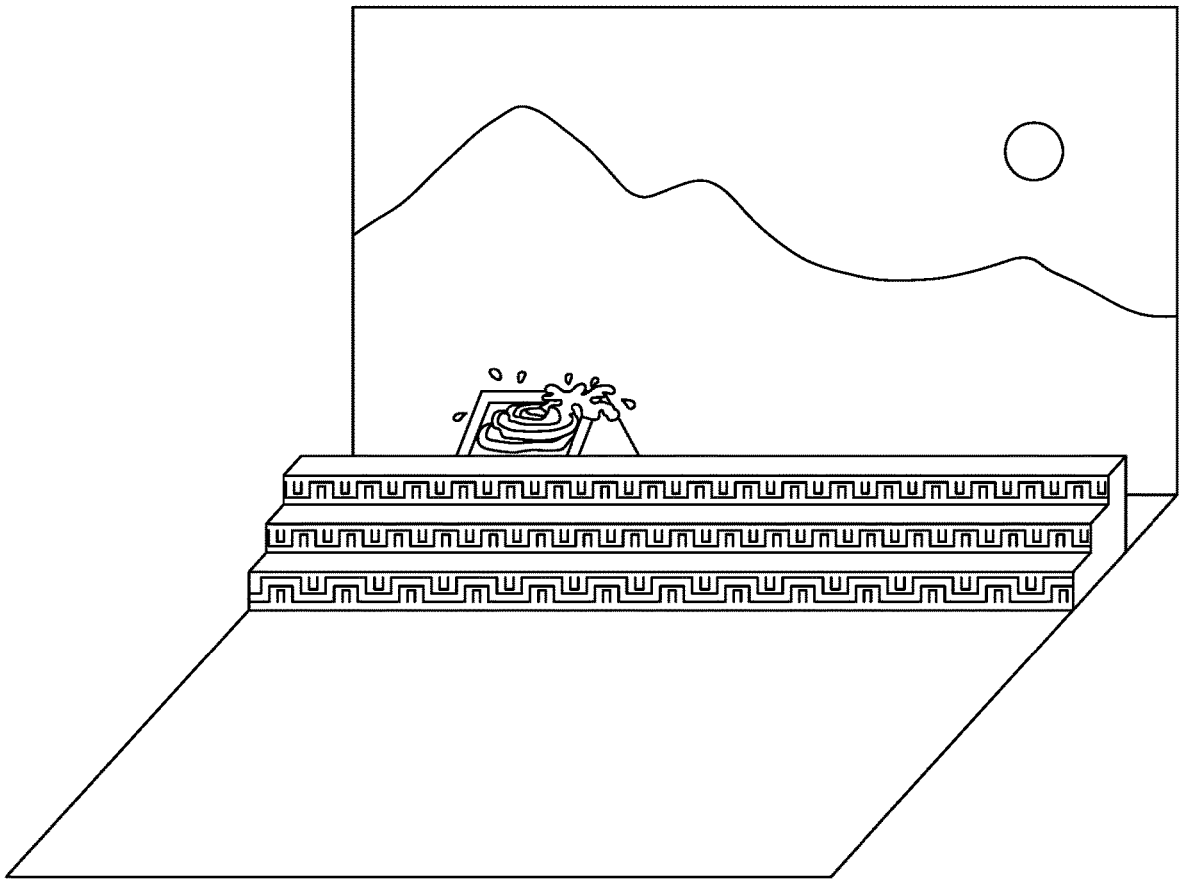

FIG. 5B shows animation of the image of the water well on the stage backdrop. The animated image shows agitation of the water in the water well, as might occur if a person or thing were approaching the surface of the water from beneath the surface of the water in an actual water well.

Figure 5C:
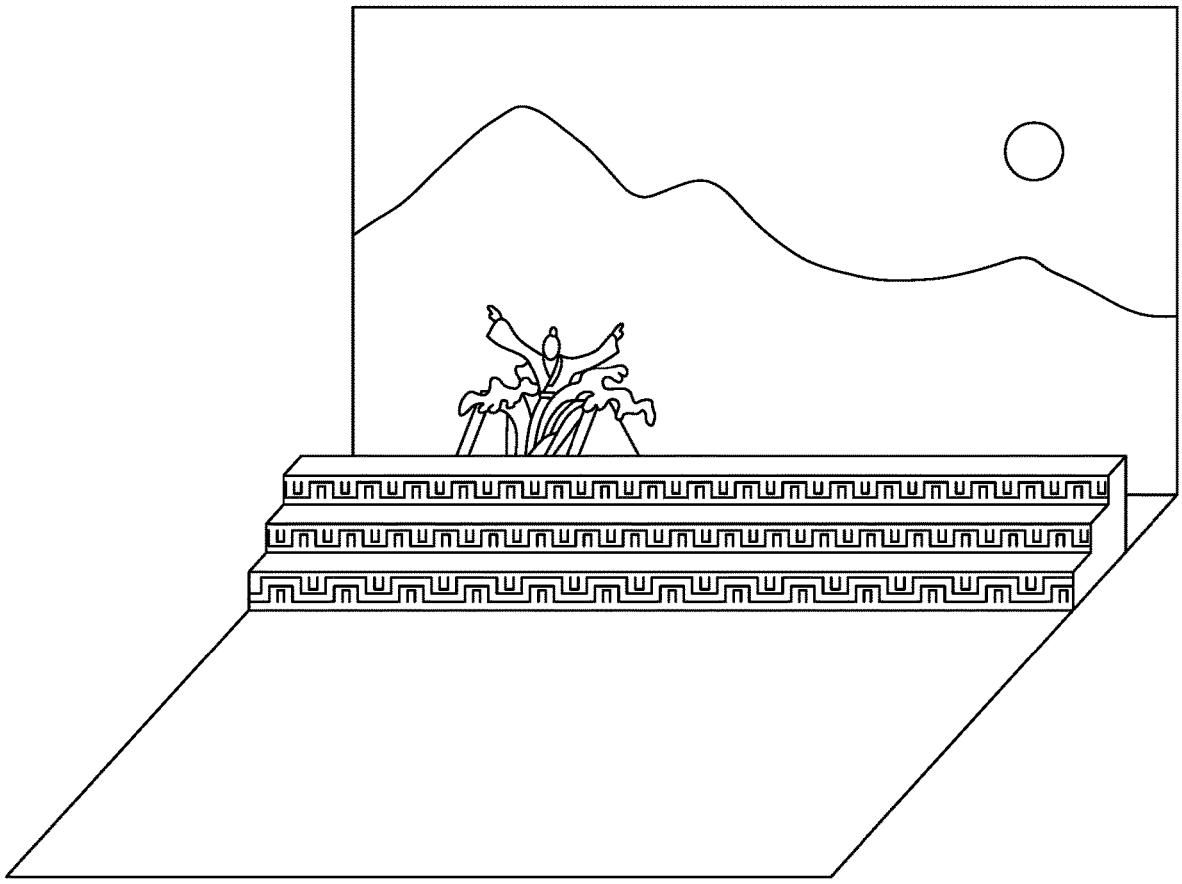

FIG. 5C shows animation of the water well at a later time, and shows an image of an actor emerging from the water in the well image, with splashes of water shown.

Figure 5D:
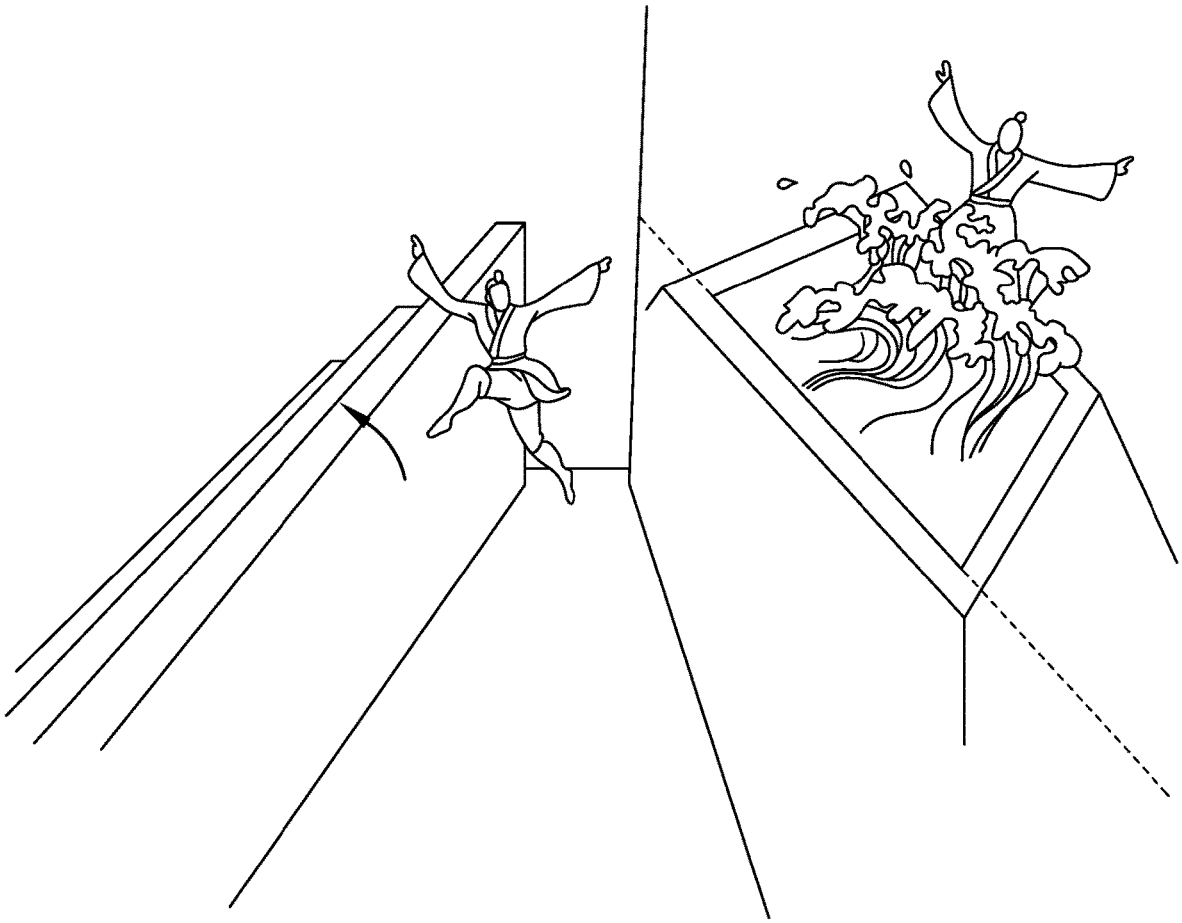

FIG. 5D shows the scene of FIG. 5C, except from a side view of the stage platform. Shown is the positioning of the raised stairs with respect to the stage backdrop on the stage platform, and the resulting space created between the raised stairs and the stage backdrop. An actor is shown located in the space, whose presence to the audience is generally obscured by the raised stairs. The actor is shown as beginning a leap up from the space, onto the top of the raised stairs, where the actor will be visible to the audience. Animation of the image of the water well, including an image of the actor emerging from the water well, and images of water splashing, are also shown on the stage backdrop.

Figure 5E:
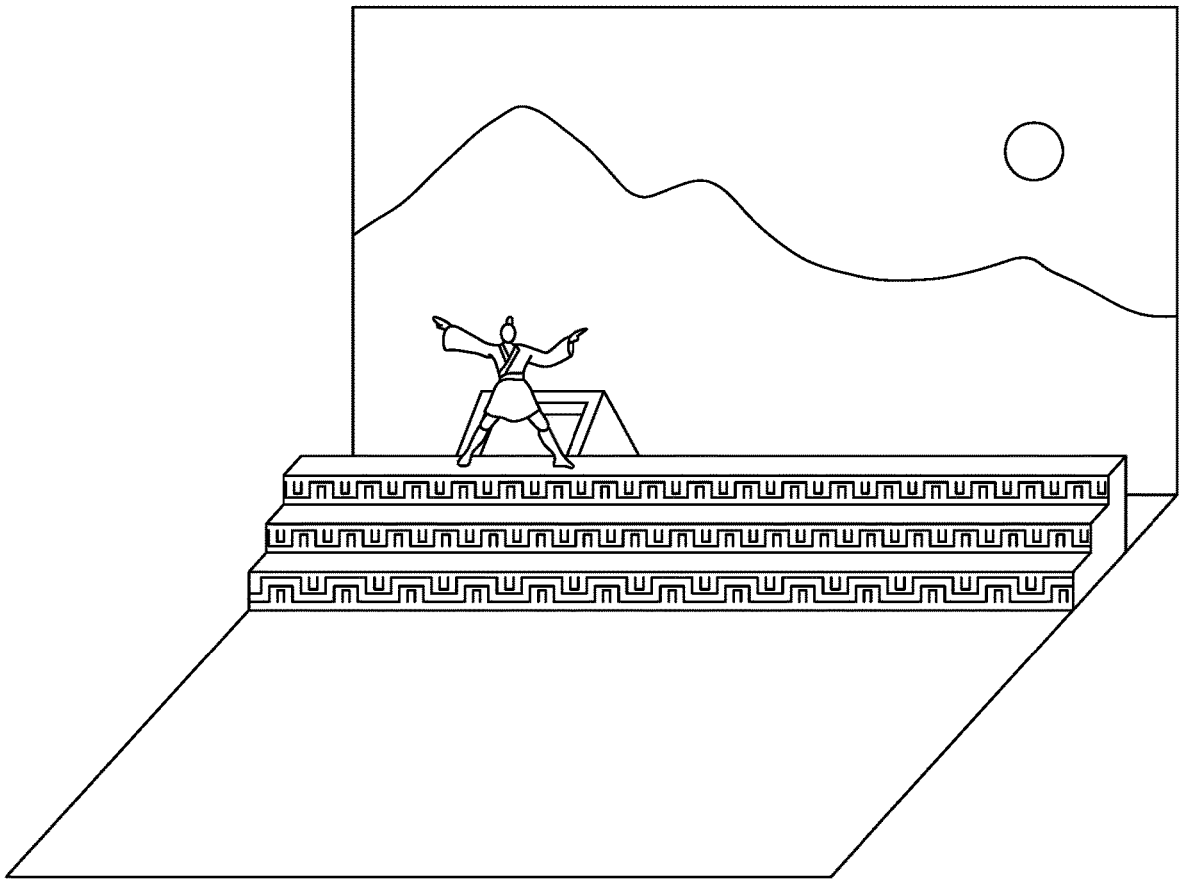

FIG. 5E shows the actor (the image of the actor on the stage backdrop is gone), seemingly fully emerged from the water well, and standing on the top step of the raised stairs.

Animation of the water well (the image of the actor emerging from the water well along with images of water splashing) has completed. The entire sequence of events shown in FIG. 5 is perceived by the audience as an actor emerging from a water well on a stage backdrop and entering onto a stage platform.

In various embodiments, the events shown in FIGS. 5A-E, that result in an actor entering onto a stage, may be followed by events that result in exit of the actor from the stage platform (FIGS. 2A-C, FIGS. 4A-F). In some examples, the prop may not be of a water well. In some examples, the raised stairs may not be present. In some examples, an object other than raised stairs may be used, for example, to obscure an actor from view of an audience.

SUMMARY

Disclosed here are methods for extending movement of an actor during a stage performance, onto or off of, a stage backdrop. Transitioning of an actor on a stage platform to an image of the actor displayed on a stage backdrop, or of an image of an actor on a stage backdrop to a live actor on a stage platform is disclosed. Generally, the transitions described herein, between an actor on a stage platform to image of the actor on a stage backdrop, or between image of an actor on a stage backdrop to the actual actor on a stage platform, involve interaction of the actor with a prop on the stage and/or interaction of an image of an actor with an image of a prop on a stage backdrop. In some examples, an actual actor may interact with an image of a prop, and/or an image of an actor may interact with an actual prop.

In some examples, this transitioning, and the way in which it occurs (using a prop or image of a prop), can provide an audience with a surreal, but realistic perception that an actor in a stage performance is transported across large distances. In some examples, transitioning of an actor from one location to another may be perceived by the audience that the actor actually is in the same location, but that the viewpoint of the audience of that location has changed.

The transitioning may be facilitated through use of a dark stage. These methods not only extend the area over which a performance on a stage may take place, but significantly expand the ways by which actors can enter onto or exit from a stage platform during a performance. These techniques enhance perception of a stage performance by an audience.

In one example, the methods may be perceived by an audience as an actor being transported from a stage platform to a stage backdrop by an object or prop (FIGS. 2A-F). In one example, the methods may be perceived by an audience as an actor being transported from a stage backdrop to a stage platform by an object or prop (FIGS. 3A-E). In one example, the methods may be perceived by an audience as an actor exiting a stage platform through or using an object or prop (FIGS. 4A-F). In one example, the methods may be perceived by an audience as an actor entering onto a stage platform through or using an object or prop (FIGS. 5A-E). The methods may be used separately, or entire or parts of the individual methods may be used together.

In one embodiment, a method for presenting a stage performance comprises, at about the time an actor interacts with a prop on a stage platform, or interacts with an image of a prop displayed on a stage backdrop, and the actor exits the stage platform, digitally displaying an image of the prop, or animating the image of the prop, on a stage backdrop, the image of the prop associated with an image of the actor on the stage backdrop during or shortly after the digital displaying or animating.

In one embodiment, a method for presenting a stage performance comprises, displaying an image of an actor on a stage backdrop, animating the image of the actor to indicate interaction of that image with an image of a prop on the stage backdrop, or to indicate interaction of that image with a prop on the stage platform, at about the time or shortly before the time the image of the actor disappears from the stage backdrop, and an actor interacts with a prop on the stage platform, and enters onto the stage platform.

In one embodiment, a method for presenting a stage performance comprises, animating an image of a prop on a stage backdrop, at about the time an actor on a stage platform interacts with the image, and exits or appears to exit the stage platform.

In one embodiment, a method for presenting a stage performance comprises, animating an image of a prop on a stage backdrop, at about the time an actor interacts with the image, and enters onto a stage platform.

DETAILED DESCRIPTION

Definitions

Herein, "about," means approximately. When a first thing is stated to occur about the time that a second thing occurs, the first thing generally occurs slightly before, at the same time, and/or slightly after, the second thing occurs. Herein, when a first thing occurs about the time that a second thing occurs, this means that an audience will generally perceive the two things to occur together, or for the occurrence of the second thing to be perceived by the audience as a reaction to occurrence of the first thing.

Herein, "actor," means a person who acts/performs in a stage performance.

Herein, "adjacent," means next to or adjoining something else. When one thing is stated to be not adjacent to a second thing, there is separation or space between the first and the second thing.

Herein, "animate," means to move or provide motion to an image, generally on a stage backdrop.

Herein, "apparent," means seemingly real or true, but not necessarily so.

Herein, "appear," means come into sight; become visible.

Herein, "around," means surrounding.

Herein, "associated," means linked or connected to.

Herein, "audience," means spectators at an event.

Herein, "border," means a boundary.

Herein, "change," means difference.

Herein, "coordinate," means to make separate elements work together.

Herein, "dark stage," means a stage that lacks lighting. A dark stage may be temporary (e.g., lighting may be turned off briefly and then turned back on) and may be used to obscure the stage and/or events occurring on the stage from an audience.

Herein, "digital," means electronic or computer based.

Herein, "disappear," means to leave view; become invisible.

Herein, "display," means to exhibit or show, generally on a stage backdrop.

Herein, "effect," means a change that is the result or consequence of an action or cause.

Herein, "enter," means to come into a location.

Herein, "exit," means to go out of or leave a location.

Herein, "image," means a representation of something. Herein, images are generally displayed on a stage backdrop during a stage performance. Generally, unless stated otherwise, an image may represent an actor. Generally, unless stated otherwise, an image may represent an object.

Herein, "initiate," means to start or begin.

Herein, "interact," means one thing interfacing with another, and/or one thing having an effect on another. Generally, herein, interact may include the one thing initiating the interfacing with the other thing.

Herein, "obscure," means conceal.

Herein, "optional," means discretionary or elective.

Herein, an "object" means a thing that can be seen or touched. Generally, an object does not include an actor.

Herein, "perceive," means to notice or be aware of something.

Herein, "precision," generally in referring to actors and images of actors and their transitioning between stage and backdrop, or backdrop and stage, refers to things like similar appearance of the actors and images of the actors that transition, and/or coordination in time and/or in space of transitioning between stage and backdrop, or backdrop and stage.

Herein, "prop," means an object, generally on a stage platform during a stage performance.

Herein, "reaction," means an action performed in response to something.

Herein, "represent," means depict.

Herein, "stage backdrop," means an area, generally behind a stage platform, on which images can be displayed Herein, "stage platform," means an area on which a stage performance is held.

Herein, "transition," means a change of or passing from one to another. Transitioning refers to making or initiating a transition. Herein, transitioning generally refers to movement of actors/props from a stage platform to a stage backdrop as images of actors/props, and/or to movement of images of actors/props that are displayed on a stage backdrop to a stage platform as actual actors/objects.

Herein, "transport," means to move from one location to another.

Herein, "viewpoint," means the position from which something or someone is observed.

Actors, Images and Transitioning

As disclosed in U.S. Patent Publication No. 2012/0225765, published on Sep. 6, 2012, U.S. Patent Publication No. 2014/0357386, published on Dec. 4, 2014, and in U.S. Pat. No. 9,468,860, issued on 18 Oct. 2016, movement of actors on a stage platform and movement of images of actors on a stage backdrop can be coordinated with one another such that the images appear, to an audience, as lifelike extensions of the actors on the stage platform. In particular, methods for precision transitioning between live actors on a stage platform to images of the same actors on a stage backdrop, or precision transitioning between images of actors on a stage backdrop to live actors on a stage platform were disclosed.

Herein, new techniques for transitioning between actors on a stage platform and images of actors on a stage backdrop, or between images of actors on a stage backdrop and actors on a stage platform, are disclosed. This transport generally involves use of a prop and/or images of props during the transitioning. The techniques disclosed here may be perceived by an audience as an actor being transported over significant distances as an actor transitions from a stage platform to an image of the same actor on a stage backdrop, or as an image of an actor transitions from a stage backdrop to the live actor on a stage platform. In some examples, the techniques disclosed, that transport actors, here may be perceived by an audience as an actor not having moved from one location to another, but as the actor located in the same location, but the audience having a different viewpoint of the location and/or actor.

In some examples, an actor positioned on a stage platform may interact with a prop positioned on the stage platform. Transitioning of the prop from the stage platform to an image of the prop that is displayed on a stage backdrop is executed and may be perceived by an audience as transport of the actor from stage platform to stage backdrop by or with the prop. The transport may give the audience the perception that the actor has traveled a great distance. In some examples, the transport may give the audience the perception that the actor has not changed locations, but that the audience has a different viewpoint of the location and/or the actor. In some examples, an actor on a stage platform may interact with an image of a prop that is displayed on a stage backdrop, prior to or around the time that the actor is perceived to be transported from the stage platform to the stage backdrop. In some examples, the transitioning may involve use of a dark stage or blackout to facilitate a scene change.

In some examples, an image of an actor displayed on a stage backdrop may interact with or appear to an audience to interact with an image of a prop also displayed on the stage backdrop. Transitioning of the image of the prop from the stage backdrop to an actual prop located on the stage platform is executed and may be perceived by an audience as transport of the actor from stage backdrop to stage platform by or with the prop. The transport may give the audience the perception that the actor has traveled a great distance. The transport may give the audience the perception that the actor is in the same location, but that the audience views the location from a different viewpoint after the transport. In some examples, the image of the actor displayed on the stage backdrop may interact or appear to interact with an actual prop located on the stage platform, prior to or around the time that the actor is perceived to be transported from the stage backdrop to the stage platform. In some examples, the transitioning may involve use of a dark stage or blackout to facilitate a scene change.

Props and Images of Props

In the methods disclosed here, objects or props facilitate transitioning of an actor from a stage platform to an image of the actor displayed on a stage backdrop, or of an image of an actor displayed on a stage backdrop to a live actor on the stage platform. The prop may be perceived as the medium that transports the actor.

Generally, for transitioning of an actor located on a stage platform to an image of an actor displayed on a stage backdrop, the actor first exits the stage platform. Generally, a prop or props are used to facilitate the actor's exit. One example of this is seen in FIG. 2B. Here, the actor leaps into the center of a prop of a water well. The perception of the actor's movements to an audience is that the actor is leaping into an actual well. If the prop were not present, the audience may not have that perception. In this particular example, the prop of the water well serves to hide or obscure the actor from the audience, as illustrated in FIG. 2C. In some, but not necessarily all examples, props may serve the purpose of obscuring an actor from an audience.

Another example of using a prop during transitioning of an actor from a stage platform is shown in FIGS. 4B-C. Here, an actor leaps off the top of raised stairs positioned on the stage platform. The raised stairs may be considered a prop. After the actor leaps from the stairs, into the space between the raised stairs and the stage backdrop, the actor is obscured from the audience by the raised stairs, as shown in FIGS. 4D-E.

FIGS. 4B-D also illustrates an example of an actor exiting a stage platform using an image of a prop. Here, the actor on top of the raised stairs leaps in a way that is perceived by the audience as leaping into an image of a water well that is displayed on the stage backdrop. As discussed above, images of water splashing out of the image of the water well reinforces this perception.

In some examples, after an actor has exited the stage platform, an image of an actor may appear on a stage backdrop. Generally, an image of a prop is used to facilitate this action. One example of this is seen in FIGS. 2E-F, where an image of an actor emerges from an image of a water well, and appears on the stage backdrop. Here, the perception to the audience is that the water well into which the actor leapt in FIGS. 2B-C, transported the actor from the stage platform to the stage backdrop, where the actor appeared as an image.

Another example of using an image of a prop to facilitate entry of an actor's image onto the stage backdrop is illustrated in FIGS. 5B-E. Here, an image of a water well prop is displayed on a stage backdrop. There is animation of the image such that water inside the well is disturbed, as if something were rising up to water surface through the well. Then, an image of the actor emerges from the water and enters onto the stage backdrop. The image of the actor was associated with the image of the water well prop and facilitated entry of the actor's image onto the stage backdrop. The perception of the audience is that the image of the water well into which the actor leapt in FIG. 4B, facilitated entry of the actor's image onto the stage backdrop.

For transitioning of an image of an actor displayed on a stage backdrop to an actual actor on a stage platform, the image may first exit or disappear from the stage backdrop. Generally, an image of a prop is used to facilitate this action. One example of this is seen in FIGS. 3A-B, where an image of an actor is animated to appear to an audience that the image of the actor is leaping into a water well. After the actor's leap, the actor is not visible to the audience, and the perception by the audience is that the actor is inside of the well.

In some examples, after an image of an actor has left the stage backdrop, an actual actor may appear on the stage platform. Generally, a prop is used to facilitate this process. One example of this is illustrated in FIGS. 3D-E. Here, a prop that represents a water well is located on a stage platform. An actor may be within the prop or on a substage beneath the prop. In this example, the actor is not visible to the audience. Then, the actor emerges from the prop and becomes visible to the audience.

Another example is of an actor entering onto a stage using an image of a prop, as illustrated in FIGS. 5A-E. Here, the actor's entry is facilitated by an image of the prop, rather than a prop itself. As shown in FIG. 5B, an image of a water well displayed on a stage backdrop is animated in a way that water within the well appears to splash. Then, an actor appears on raised stairs that are positioned on the stage platform. An image of the actor may also be shown to emerge from the image of the water well.

In the examples illustrated herein, props may be used as a platform or medium to facilitate entry or exit of an actor onto or from a stage platform. Images of props may also be used to facilitate entry and/or exit onto or from a stage platform. Images of props may be used to facilitate entry and/or exit of an image of an actor from or onto a stage backdrop. Actual props may also be used to facilitate entry and/or exit of an image of an actor from or onto a stage backdrop.

Herein, the exemplified prop/image of a prop is a water well. Many other types of props/images of props can be envisioned. There are many possible examples. One can readily envision props that represent objects such as vehicles (for land, water, air, space), buildings, celestial objects, objects in nature (e.g., a waterfall), and a host of others, can be used as points of interaction of actors, on a stage platform, or a stage backdrop, that facilitate the transitioning described herein, and/or create a perception by an audience that an actor is being transported between locations, or that the audience's viewpoint or perspective of the same location has changed, during a stage performance. The disclosed methods also may be used to enhance exit from or entrance onto a stage platform of an actor, or appearance on or disappearance from a background display of an image of an actor used in a stage performance.

Transporting Actors

The methods described here are generally used to give an audience viewing a stage performance the perception that an actor moves across significant distances. In some examples, the perception may be that the audience has a different viewpoint of an actor in what appears to be the same location (e.g., the location of the actor on the stage platform appears to be the same location where the actor/image is located on the stage backdrop, but the audience's viewpoint has changed.) This perception arises as a result of the transitioning of an actor between stage platform and stage backdrop, or of an image of an actor between stage backdrop and stage platform.

In some examples, using the described methods, an actor exiting from a stage platform may appear on a stage backdrop as an image, near or adjacent to the location where the actor exited the stage platform (e.g., compare FIG. 4B, exit of actor from the stage platform; with FIGS. 2E-F, appearance of an image of an actor on the stage backdrop). In some examples, an image of an actor disappearing from a stage backdrop may enter onto a stage platform as an actor, near or adjacent to the location where the image disappeared from the stage backdrop (e.g., compare FIGS. 3A-B, disappearance of an image of an actor from the stage backdrop; with FIGS. 5C-E, entry of the actor onto the stage platform).

In some examples, using the described methods, an actor exiting from a stage platform may appear on a stage backdrop as an image, far away from or non-adjacent to the location where the actor exited the stage platform. However, in some examples, even though the actor has been transported from stage platform to an image on the stage backdrop, the audience may perceive the actor to be in the same location but, after the transport, the audience has a different viewpoint of the location (e.g., compare FIGS. 2B-C, exit of actor from the stage platform; with FIGS. 2E-F, appearance of an image of the actor on the stage backdrop).

In some examples, an image of an actor disappearing from a stage backdrop may enter onto a stage platform as an actor, far away from or non-adjacent to the location where the image disappeared from the stage backdrop. However, in some examples, even though the image of the actor has been transported from stage backdrop to an actual actor on the stage platform, the perception of the audience may be that, after the transport, the actor is in the same location, but the audience has a different viewpoint of the location and/or actor (e.g., compare FIGS. 3A-B, disappearance of an image of an actor from the stage backdrop; with FIGS. 3D-E, entry of the actor onto the stage platform).

Dark Stage

Some transitions between actors and images, or between images and actors, during a stage performance, may be better perceived by an audience if a transient dark stage or stage platform blackout is used to prevent an audience from viewing what occurs on the stage platform/stage backdrop. For example, a dark stage may obscure the audience's view of stagehands entering onto the stage platform to add or remove props from the stage platform. FIG. 2D and FIG. 3C are examples of use of a dark stage during a transition, as described herein.

Coordination and Precision of Transitioning

A property of the disclosed methods is transitioning from actors and/or objects/props on a stage platform to images of actors/objects/props on a stage backdrop, or transitioning from images on a stage backdrop to actors and/or objects on a stage platform.

Generally, this transitioning is coordinated in time so that, at about the time an actor/object/prop exits the stage platform, images of the same appear on the stage backdrop. Likewise, at about the time an image disappears from the stage backdrop, actors/objects/props that are represented by the images, appear on the stage platform.

Generally, coordination of location of the transitioning is also relevant. Herein, the transitioning, in some examples, has the property of, and appears to the audience as, transporting objects/props/actors across significant distances. In some examples, however, the audience may perceive the transport as a change in viewpoint of the same location. In FIGS. 2A-F, for example, an actor exits a stage platform by leaping into the water well prop that is located in the middle of the stage platform. At about that time, or slightly after the time the actor leaps, an image of the actor appears on the stage backdrop, after emerging from an image of the water well that is displayed on the stage backdrop. The physical locations of the water well prop on the stage platform and the image of the water well displayed on the stage backdrop are separated by physical distance in FIGS. 2A-F. In other words, these two locations are not adjacent. However, the audience may perceive the change in physical distance to be the same location, but that they have a different viewpoint of the location after the transitioning. Generally, the perception of the audience may be influenced/controlled by the way in which the methods are implemented.

In some examples, the locations of the actors/objects/props and images of those may be adjacent, meaning that exit of objects/props/actors from a stage platform occurs in about the location where images of the objects/props/actors appear on the stage backdrop, and vice versa (i.e., transitioning from images on a stage backdrop to object/props/actors on a stage platform). This adjacency of the transitioning is discussed in more detail in U.S. Pat. No. 9,468,860.

Generally, the transitioning is also coordinated in movement. An example of this is illustrated in FIGS. 4A-F where, when the actor leaps off the raised stairs, seemingly into the image of the water well that is displayed on the stage backdrop, images of water splashes directed out of the image of the water well are displayed. The perception of the audience is that the actor has indeed leapt into a water well, producing a splash of the water therein.

These coordinations of time, location, and movement during the transitioning are designed to contribute to the experience of the viewing audience, such that the images are an extension of the stage platform.

In addition to the coordination during the transitioning that occurs in the disclosed methods, transitioning between objects/props/actors on the stage platform and images of those displayed on a stage backdrop, or transitioning between the images and the objects/props/actors, has a property or characteristic of precision. In some examples of precision, the visual appearance of the objects/props/actors and the paired images is similar or identical. For example, the costumes of the live actors are the same as the costumes of the images of the actors. The colors of the costumes are the same. In some examples, the facial appearance images of actors is also very similar or identical to the appearance of the paired live actors. The appearance to the audience is that the actor on the stage and the paired image displayed on the stage backdrop are the same person.

Producing Images and Animation

Images of actors/objects/props that are displayed or projected onto a stage backdrop can be made using methods and instruments known in the art. There are a variety of ways to produce, display and animate the images. The technology to do these things becomes easier to use and less expensive over time.

In some examples, methods used to produce digital images (consecutive images constitute an animation), to integrate these images into the backgrounds generally displayed on stage backdrops (e.g., the mountain horizon and the sun in the sky as illustrated in FIGS. 2A-F), and to coordinate the digital displays of actors/objects/props and background with actual actors/objects/props on the stage platform can be described as below. Some of this is described in U.S. Pat. No. 9,468,860.

Digital images, of an actor for example, can be captured using a digital video camera. The actor may be filmed against a single-color background, performing a variety of movements. The movements to be captured using the video camera are planned, based on the desired movements of images of the actors on a stage backdrop during a stage performance. In one example, the actor whose image is captured during this step is the same actor that will be performing on the stage platform during the stage performance. Generally, the costumes worn by the actors during the video capture step are exactly tailored to match the costumes worn by the paired actor on stage. In synthesizing video, a video designer may account for precise body measurements, costume colors, sizes, shapes and curvature, lighting conditions, precise positioning on stage, dance movements at the time of transitioning etc., so that the digitized images look exactly like the on-stage live actor. This is the precision of the system and method.

In a next step, video editing software may be used to extract the image(s) of the actor(s), from the image(s) captured using the video camera, digitally onto a computer. Alternatively, it may be that the software is used to remove the single-color background, leaving only the image(s) of the actor(s).

The extracted video images of the actor may be stored on a first computer system. A second computer system may store a video of the desired background (e.g., the example mountain horizon and the sun in the sky as illustrated in FIGS. 2A-F). A video switcher, that switches between video output from the two computer systems, or blends output from both, may be used during the stage performance to provide video images of the actor at the correct time during the stage performance and, thus, provide the transitioning between actors/objects/props and images, or between images and actors/objects/props. Other arrangements of computers, video switchers and display devices may be used. Some of these alternatives are described in U.S. Pat. No. 9,468,860.

EMBODIMENTS

Example embodiments of the invention are disclosed in the numbered paragraphs below.

Embodiments Generally Related to the Example Methods of FIGS. 2A-F

1. A method for presenting a stage performance, comprising:

transitioning between an actor on a stage platform and an image of the actor on a stage backdrop; or transporting an actor on a stage platform to a stage backdrop where the actor appears as an image;

using a prop or object, and an image of a prop or object, to perform the transitioning or transporting.

2. The method of embodiment 1, where an animation of the prop occurs about the time of the transitioning or transporting.

3. A method for presenting a stage performance, comprising:

animating an image of an object on a stage backdrop, after an actor interacts with the object on a stage platform, and about the time the actor exits or appears to exit the stage platform.

4. The method of embodiment 3, where the image of the object on the stage backdrop includes an image of the actor.

5. The method of embodiment 3, where the image of the object on the stage backdrop includes an image of the actor entering onto the stage backdrop.

6. The method of embodiment 3, where the animating of the image of the object on the stage backdrop is coordinated with the interaction of the actor with the object on the stage platform.

7. The method of embodiment 3, where a transitioning between the actor on the stage platform interacting with the object, and the animated image of the object on the stage backdrop, includes obscuring the stage platform from an audience.

8. The method of embodiment 3, where the object on the stage platform includes a prop that represents a water well, the image of the object includes an image of a water well, interaction of the actor with the object on the stage platform includes the actor entering into the prop of the water well, and the image of the object on the stage backdrop includes images of the actor emerging from the image of the water well onto the stage backdrop.

9. Animating an image of an object on a stage backdrop, after an actor on a stage platform interacts with the object on the stage platform, and about the time the actor appears to an audience to exit the stage platform, the animating of the image appearing to the audience as an effect of the interaction of the actor with the object.

10. A method for enhancing an exit of an actor from a stage platform during a stage performance, comprising:

digitally animating an image of an object on a stage backdrop, at about the time an actor interacts with an object on a stage platform and exits the stage platform, the image being an image of the object on the stage platform;

the digital animating occurring at a location on the stage backdrop that is not adjacent to a location where the actor exits the stage platform; and where the appearance to an audience is that the animation of the image is initiated by, or is an effect of, the interaction of the actor with the object on the stage platform.

11. A method, comprising:

positioning an object on a stage platform, the object capable of obscuring from an audience, an actor that enters the object;

obscuring the stage platform from the audience after an actor enters the object on the stage platform;

disclosing the stage platform to the audience after which an image of the object is displayed on a stage backdrop; and animating the image of the object such that an image of the actor appears to the audience to emerge from the image of the object.

Embodiments Generally Related to the Example Methods of FIGS. 3A-E

12. A method for presenting a stage performance, comprising:

transitioning between an image of an actor on a stage backdrop and an actor on a stage platform;

or transporting an image an image of an actor on a stage backdrop to a stage platform where the image appears as an actor;

using a prop or object, and an image or a prop or object, to perform the transitioning or transporting.

13. The method of embodiment 12, where an animation of the prop occurs about the time of the transitioning or transporting.

14. A method for presenting a stage performance, comprising animating an image of an object on a stage backdrop, about the time an image of an actor interacts with the image of the object on the stage backdrop, and before the object appears on a stage platform.

15. The method of embodiment 14, where the actor exits the object and enters onto the stage platform.

16. The method of embodiment 14, where a transitioning between the animated image of the object on the stage backdrop and the object on the stage platform, includes obscuring the stage platform from the audience.

17. The method of embodiment 14, where the image of the object on the stage backdrop includes an image of a water well, interaction of the image of the actor with the image of the object includes an image of an actor jumping into the image of the water well, and the object on the stage platform includes a prop of a water well.

18. Animating an image of an object on a stage backdrop, at about the time an image of an actor interacts with the image of the object on the stage backdrop, and before the object appears on a stage platform and the actor emerges from the object and enters onto the stage platform.

19. A method for enhancing an entrance of an actor onto a stage platform during a stage performance, comprising:

digitally animating an image of an object on a stage backdrop, at about the time an image of an actor interacts with the image of the object on the stage backdrop, and before the time a prop of the object appears on a stage platform and the actor emerges from the prop of the object and enters onto the stage platform;

the digital animating occurring at a location on the stage backdrop that is not adjacent to a location where the actor emerges from the prop of the object onto the stage platform; and where the appearance to an audience is that emergence of the actor from the prop of the object onto the stage platform is initiated by, or is an effect of, the interaction of the image of the actor with the image of the object on the stage backdrop.

20. A method, comprising:

animating an image of an object on a stage backdrop at about the time an image of an actor appears to an audience to enter into the image of the object;

obscuring the stage backdrop and a stage backdrop from the audience;

disclosing the stage platform to the audience after which a prop of the object appears on a stage platform; and entering onto the stage platform of an actor that emerges from the prop of the object.

Embodiments Generally Related to the Example Methods of FIGS. 4A-F

21. A method for presenting a stage performance, comprising:

animating an image of an object on a stage backdrop, at about the time an actor on a stage platform interacts with the image, and exits or appears to exit the stage platform.

22. The method of embodiment 21, where the image of the object on the stage backdrop includes an image of the actor.

23. The method of embodiment 21, where the image of the object on the stage backdrop includes an image of the actor entering onto the stage backdrop.

24. The method of embodiment 21, where the animating of the image of the object is coordinated with the interaction of the actor with the image.

25. The method of embodiment 21, where the image of the object on the stage backdrop includes an image of a water well, interaction of the actor with the image includes the actor appearing to an audience as entering into the image of the water well and exiting the stage platform, and the animating of the image includes an image of water splashing out of the water well.

26. Animating an image of an object on a stage backdrop, at about the time an actor on a stage platform interacts with the image and the actor appears to exit the stage platform, the animating of the image appearing to an audience as an effect of the interaction of the actor with the image of the object.

27. A method for enhancing an apparent exit of an actor from a stage platform during a stage performance, comprising:

digitally animating an image of an object on a stage backdrop, at about the time an actor interacts with the image and the actor appears with the image and exits appears to exit the stage platform;

the digital animating occurring at a location on the stage backdrop that is adjacent to a location where the actor exits the stage platform;

where the appearance to an audience is that the animation of the image is initiated by, or is an effect of, the interaction of the actor with the image.

28. A method, comprising:

displaying a digital image of an object on a stage backdrop, where the digital image is defined by a transparent border around the digital image of the object;

displaying a digital image of an actor within the transparent border when an actor on a stage platform adjacent to the stage backdrop appears to an audience to exit the stage platform; and displaying a change in the digital image so as to show a reaction to the apparent exiting of the actor from the stage platform.

Embodiments Generally Related to the Example Methods of FIGS. 5A-E

29. A method for presenting a stage performance, comprising:

animating an image of an object on a stage backdrop, at about the time an actor interacts with the image and enters onto a stage platform.

30. The method of embodiment 29, where the image of the object on the stage backdrop includes an image of the actor.

31. The method of embodiment 29, where the image of the object on the stage backdrop includes an image of the actor emerging from the image of the object.

32. The method of embodiment 29, where the animating of the image of the object is coordinated with the interaction of the actor with the image.

33. The method of embodiment 29, where the image of the object on the stage backdrop includes an image of a water well, interaction of the actor with the image includes the actor appearing to an audience as exiting the image of the water well and entering onto the stage platform, and the animating of the image includes an image of water splashing out of the water well.

34. Animating an image of an object on a stage backdrop, at about the time an actor interacts with the image and enters onto a stage platform, the animating of the image appearing to an audience as an effect of the interaction of the actor with the image of the object.

35. A method for enhancing an entrance of an actor onto a stage platform during a stage performance, comprising:

digitally animating an image of an object on a stage backdrop, at about the time an actor interacts with the image and the actor enters onto the stage platform;

the digital animating occurring at a location on the stage backdrop that is adjacent to a location where the actor enters onto the stage platform;

where the appearance to an audience is that the interaction of the actor with the image is initiated by, or is an effect of, the digital animation of the image.

36. A method, comprising:

displaying a digital image of an object on a stage backdrop, where the digital image of the object is defined by a transparent border around the digital image of the object;

displaying a change in the digital image of the object when an actor appears within the transparent border around the digital image and enters onto a stage platform adjacent to the stage backdrop;

where the change in the digital image of the object appears to be a reaction to the entrance of the actor onto the stage platform.

Additional Embodiments

37. A method for presenting a stage performance, comprising:

at about the time an actor interacts with a prop on a stage platform or interacts with an image of a prop displayed on a stage backdrop, and the actor exits the stage platform, displaying an image of the prop on the stage backdrop if the actor interacts with the prop, or animating an image of the prop on the stage backdrop if the actor interacts with an image of the prop; and at about the time the actor exits the stage platform, displaying an image of the actor on the stage backdrop;

wherein the image of the actor interacts with the image of the prop or with the animated image of the prop.

38. A method for presenting a stage performance, comprising:

displaying an image of a prop on a stage backdrop, and animating an image of an actor on the stage backdrop to indicate interaction of the image of the actor with the image of the prop; and ceasing to display the image of the actor on the stage backdrop at about the time or shortly before an actor interacts with a prop on the on a stage platform and enters onto the stage platform.

39. A method for presenting a stage performance, comprising:

displaying an image of an actor on a stage backdrop, animating the image of the actor to indicate interaction of that image with an image of a prop on the stage backdrop, or to indicate interaction of that image with a prop on the stage platform, at about the time or shortly before the time the image of the actor disappears from the stage backdrop, and an actor interacts with a prop on the stage platform, and enters onto the stage platform;

wherein the image of the actor is at least partially obscured from view of an audience by the prop or by a change of lighting, such that the image of the actor cannot be seen exiting the stage backdrop.

40. A method for presenting a stage performance, comprising:

placing a raised stage platform in front of a stage backdrop;

displaying and/or animating an image of a prop on the stage backdrop at a position within the same focal plane as the raised stage platform;

displaying and/or animating an image of an actor on the stage backdrop at a position within the same focal plane as the raised stage platform; and removing the displayed and/or animated image of the actor from the stage backdrop at about the time an actor enters onto the raised stage platform at about the same position as the image of the prop.

To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the detailed description or claims (e.g., A or B) it is intended to mean "A or B or both". When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995).

I claim:

1. A method for presenting a stage performance, comprising:

at the time an actor on a stage platform exits the stage platform through an opening in the stage platform large enough for the actor to enter, wherein the opening is hidden from an audience by a prop, and the actor becomes not visible to the audience digitally displaying an image of the prop on a stage backdrop located behind the stage platform, and an image of the actor entering onto the stage backdrop and wherein the image of the actor displayed on the stage backdrop includes a digital image of actual movements of the actor that were captured and are stored.

2. The method of claim 1, wherein stage lights are dimmed or turned off at the time the actor exits the stage platform, and the stage platform is not visible to an audience, until the images are digitally displayed on the stage backdrop and the stage lights are turned on.

3. The method of claim 1, wherein the opening in the stage platform includes a trap door.

4. The method of claim 1, wherein the prop includes a water well.

5. The method of claim 4, wherein the image of the prop includes an image of a water well and the image of the actor enters onto the stage backdrop by emerging from the image of the water well.

6. A method for presenting a stage performance, comprising:

digitally displaying an image of an actor and of a prop on a stage backdrop located behind a stage platform and animating the image of the actor as the image of the actor exits the stage backdrop at the time an actor enters onto the stage platform through an opening in the stage platform large enough for the actor to enter, wherein the opening is hidden from an audience by a prop and wherein the image of the actor displayed on the stage backdrop includes a digital image of actual movements of the actor that were captured and are stored.

7. The method of claim 6, wherein stage lights are dimmed or turned off at the time the image of the actor exits from the stage backdrop, and the stage platform is not visible to an audience, until the actor enters onto the stage platform and the stage lights are turned on.

8. The method of claim 6, wherein the opening in the stage platform includes a trap door.

9. The method of claim 6, wherein the prop includes a water well.

10. The method of claim 9, wherein the image of the prop includes an image of a water well and the image of the actor exits the stage backdrop by leaping into the image of the water well.

11. A method for presenting a stage performance, comprising:

a) animating an image of a prop on a stage backdrop, at the time an actor on raised stairs positioned on a stage platform, in front of the stage backdrop to create a space between the raised stairs and the stage backdrop, leaps into the space, is hidden from an audience by the raised stairs and appears to exit the stage platform; or b) animating an image of a prop on a stage backdrop, at the time an actor hidden from an audience and located in a space between raised stairs positioned on a stage platform, in front of the stage backdrop to create the space between the raised stairs and the stage backdrop, leaps from the space and enters onto the stage platform.

12. The method of claim 11, wherein the image of a prop includes an image of a water well.

* * * * *